United States Patent [19]

Beckett

[11] Patent Number: 4,515,579

[45] Date of Patent: May 7, 1985

[54] PROGRAMMABLE CASE SET-UP AND BOTTOM SEALING MACHINE

[75] Inventor: Joel M. Beckett, Eatonville, Wash.

[73] Assignee: Marq Packaging Systems, Inc., Yakima, Wash.

[21] Appl. No.: 435,363

[22] Filed: Oct. 20, 1982

[51] Int. Cl.[3] ..... B31B 3/00

[52] U.S. Cl. ..... 493/1; 493/18; 493/23; 493/141; 493/181

[58] Field of Search ..... 493/1, 2, 17, 18, 23, 493/122–127, 29, 33, 141, 181; 53/7.5

[56] References Cited

U.S. PATENT DOCUMENTS

| | | | |
|---|---|---|---|
| 3,364,827 | 1/1968 | Schmitz | 493/2 |
| 3,775,937 | 12/1973 | Devan | 53/7.5 |
| 3,885,372 | 5/1975 | Perez | 53/7.5 |
| 3,894,380 | 7/1975 | Poulsen | 53/7.5 |
| 3,973,375 | 8/1976 | Loveland | 53/7.5 |

*Primary Examiner*—Leon Gilden

*Attorney, Agent, or Firm*—Christensen, O'Connor, Johnson & Kindness

[57] ABSTRACT

A case set-up and bottom sealing machine, including a programmable controller that controls: (a) the movement of cases from a hopper to a case set-up station and, then, to a mandrel station; (b) the erecting of cases at the case set-up station; (c) the tucking or folding of the bottom minor and major flaps of erected cases at the case set-up station; (d) the application of glue to the bottom flaps during movement from the case set-up station to the mandrel station; and (e) the application of pressure to the bottom flaps to adhere the flaps together at the mandrel station, is disclosed. If the case includes Tab-Lok top flaps, the case set-up and bottom sealing machine can be programmed to fold the Tab-Lok flaps into a position such that the Tab-Lok flaps overlap the sides of the case when the case is erected. The programmable controller controls the operation of the case set-up and bottom sealing machine in accordance with operator inserted instructions, which includes case length, glue pattern length and compression time instructions, plus on/off instructions regarding glue application and glue format (stitch or continuous). The readily changeable operator inserted instructions are entered via a control/display unit, which displays information about the function and changes being made when the instructions are being entered and case count information when the case set-up and bottom sealing machine is running.

39 Claims, 17 Drawing Figures

GLUE-STITCH PROGRAM SUBROUTINE

TIMING SUBROUTINE

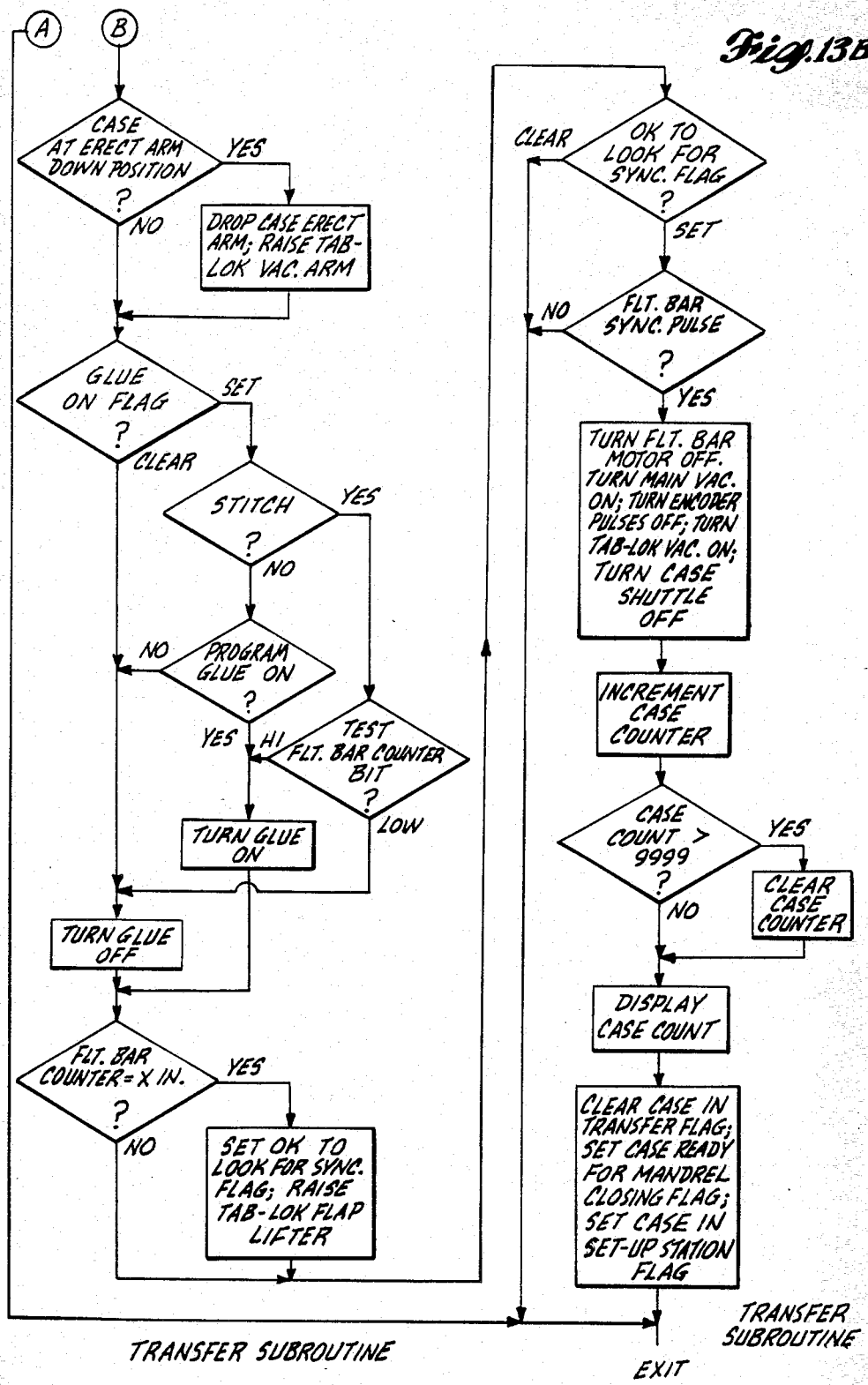
Fig. 13B.
A
B
CASE AT ERECT ARM DOWN POSITION ?
YES
NO
DROP CASE ERECT ARM; RAISE TAB-LOK VAC. ARM
GLUE ON FLAG ?
SET
CLEAR
STITCH ?
YES
NO
PROGRAM GLUE ON ?
NO
YES
TEST FLT. BAR COUNTER BIT ?
HI
LOW
TURN GLUE ON
TURN GLUE OFF
FLT. BAR COUNTER = X IN. ?
YES
NO
SET OK TO LOOK FOR SYNC. FLAG; RAISE TAB-LOK FLAP LIFTER
OK TO LOOK FOR SYNC. FLAG ?
CLEAR
SET
FLT. BAR SYNC. PULSE ?
NO
YES
TURN FLT. BAR MOTOR OFF. TURN MAIN VAC. ON; TURN ENCODER PULSES OFF; TURN TAB-LOK VAC. ON; TURN CASE SHUTTLE OFF
INCREMENT CASE COUNTER
CASE COUNT > 9999 ?
YES
NO
CLEAR CASE COUNTER
DISPLAY CASE COUNT
CLEAR CASE IN TRANSFER FLAG; SET CASE READY FOR MANDREL CLOSING FLAG; SET CASE IN SET-UP STATION FLAG
TRANSFER SUBROUTINE
TRANSFER SUBROUTINE
EXIT

PROGRAMMABLE CASE SET-UP AND BOTTOM SEALING MACHINE

TECHNICAL AREA

This invention is directed to case handling machines and, more particularly, to case set-up and sealing machines.

BACKGROUND OF THE INVENTION

In the past, various types of case handling machines have been developed. Case handling machines include machines for assembling or erecting cases, machines for sealing cases and machines for placing inserts in cases, plus various combinations thereof. For example, some case handling machines both assemble or erect cases and, then, partially seal the erected cases. Other case handling machines merely seal cases. In some instances, sealing is accomplished using an adhesively coated tape. In other cases, an adhesive is applied directly to the major and/or minor flaps of the case to be sealed.

The present invention is directed to case handling machines suitable for automatically erecting cases, folding the bottom major flaps of the cases over the bottom minor flaps and attaching the bottom major and minor flaps together using an adhesive. Generically, such machines are known as case set-up and bottom sealing machines. Case set-up and bottom sealing machines are suitable for erecting and bottom sealing open top cases, conventional cases, i.e., cases having top major and minor flaps suitable or closing the top of a case after the case is filled and Tab-Lok cases. Tab-Lok cases are cases having top major and minor flaps that can be positioned so as to overlap the sides of a case when the case is erected. Tabs between a pair of adjacent major and minor flaps maintain the major and minor flaps in the side overlapping position until the joining tab is broken. After the joining tab is broken, the flaps can be folded to close the open top of the case in the same manner as the major and minor flaps of a standard case.

In the past, case set-up and bottom sealing machines have been either entirely manually controlled or semi-automatically controlled. Manually controlled machines are undesirable because they are slow and labor intensive. While semi-automatically controlled machines are faster and, generally, decrease the amount of skilled labor needed, semi-automatically controlled machines have other disadvantages.

The major disadvantage of prior art semi-automatically controlled case set-up and bottom sealing machines is the difficulty in changing the mode of operation of such machines. Mode of opertion changes vary from changes in case length to changes in type of case to be erected and bottom sealed, e.g., Tab-Lok to open top. In order to change the mode of operation of prior art case set-up and bottom sealing machines, various adjustments must be made by a skilled mechanic. Moreover, the mechanical control systems used in prior art machines (which include timing wheels and related mechanical devices) are subject to wear and, thus, relatively frequent adjustment by a skilled mechanic. In addition to the cost attendant to the services of a skilled mechanic, the loss of machine time (e.g., machine downtime) attendant to such changes is greater than desirable. Machine downtime is undesirable for two reasons—the idle time of the machine operator; and, the idle time of employees filling the cases being assembled by the machine. Further, the ability to control the amount and pattern of the glue applied to seal the bottom of cases is severly limited in prior art case set-up and bottom sealing machines. Thus, there is a need for a case set-up and bottom sealing machine having a control system that is not subject to mechanical wear and whose mode of operation can be rapidly changed.

SUMMARY OF THE INVENTION

In accordance with this invention, a case set-up and bottom sealing machine including a programmable controller is provided. The programmable controller controls: the movement of cases through the machine; the erecting of cases; the tucking of the bottom minor and major flaps of erected cases; the application of glue to the bottom flaps; and, the pressing of the bottom flaps together to cause them to adhere to one another.

In accordance with other aspects of this invention, if the case includes Tab-Lok top flaps, the programmable controller of the case set-up and bottom sealing machine controls the position of the Tab-Lok flaps prior to case erection such that the Tab-Lok flaps overlap the sides of the case when the case is erected.

In accordance with further aspects of this invention, flattened cases are moved from a hopper to a case set-up station; case erection and bottom minor and major flap folding sequentially occur at the case set-up station; glue is applied as an erected case is moved from the set-up station to a mandrel station; and, the bottom flaps are pressed together at the mandrel station. Preferably, glue is applied by a glue head that slips between the bottom major and minor flaps. Also, preferably, erected cases are moved from the case set-up station to the mandrel station by a chain driven flight bar mechanism. Further, preferably, at the mandrel station a mandrel enters the case and presses the bottom major and minor flaps against a stop, causing the flaps to adhere to one another.

In accordance with still other aspects of this invention, the programmable controller can be programmed to control various machine functions and, thus, the mode of operation of the case set-up and bottom sealing machine. If desired, the glue head can be inhibited from applying glue as a case is moved from the case set-up station to the mandrel station whereby cases are only erected. Or, the programmable controller can control the pattern of the glue emitted by the glue head such that either a continuous or an intermittent (e.g., stitch) glue pattern occurs. Further, the glue pattern length can be controlled such that the chosen pattern can cover substantially the entire length of the cases passing the glue head, or only a portion thereof. As a result, the amount of glue applied and, thus, the bottom flap sealing strength can be tailored to the ultimate use of the sealed cases. Further, glue application tailoring limits excessive glue use and spattering. Finally, mandrel compression time can be varied so that only the amount of time needed to cause the bottom major and minor flaps to adhere to one another occurs. As a result, machine cycle time can be minimized without loss of flap sealing strength.

In accordance with yet other aspects of this invention, the programmable controller includes: a central processing unit; a control/display unit; various sensing switches; and, a position encoder that is actuated by the chain driven flight bar mechanism. Preferably, the central processing unit includes a microprocessor that is programmed by the operator of the case set-up and bottom sealing machine via the control/display unit. Regardless of its nature, based on operator instructions entered during programming subroutines, during a run subroutine the central processing unit controls the operation of various mechanical mechanisms that: move flattened cases from the hopper to the case set-up station; erect and fold the bottom flaps of cases at the case set-up station; move cases from the case set-up station past the glue head to the mandrel station; and press the bottom flaps together at the mandrel station. Further, the central processing unit controls the configuration (continuous or intermittent) and length of the glue pattern (if glue is applied). Preferably, the central processing unit includes a counter that records the number of cases erected (and bottom sealed) and the control/display unit includes an alphanumeric display that displays the box count information.

As will be readily appreciated from the foregoing summary, the invention provides a case set-up and bottom sealing machine whose mode of operation can be rapidly changed. Further, because the controller is in the form of a control/display unit and a microprocessor, machine adjustments caused by controller changes due to mechanical wear are avoided. Because the mode of operation of case set-up and bottom sealing machines formed in accordance with the invention can be rapidly changed via the control/display unit and because mechanical wear is avoided, machine downtime is low. Hence, the invention overcomes the disadvantages of prior art case set-up and bottom sealing machines of the type discussed above.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIGS. 13A and 13B are a flow diagram illustrating a transfer subroutine suitable for inclusion in the run subroutine illustrated in FIG. 10;

DESCRIPTION OF THE PREFERRED EMBODIMENT

Figure 1:
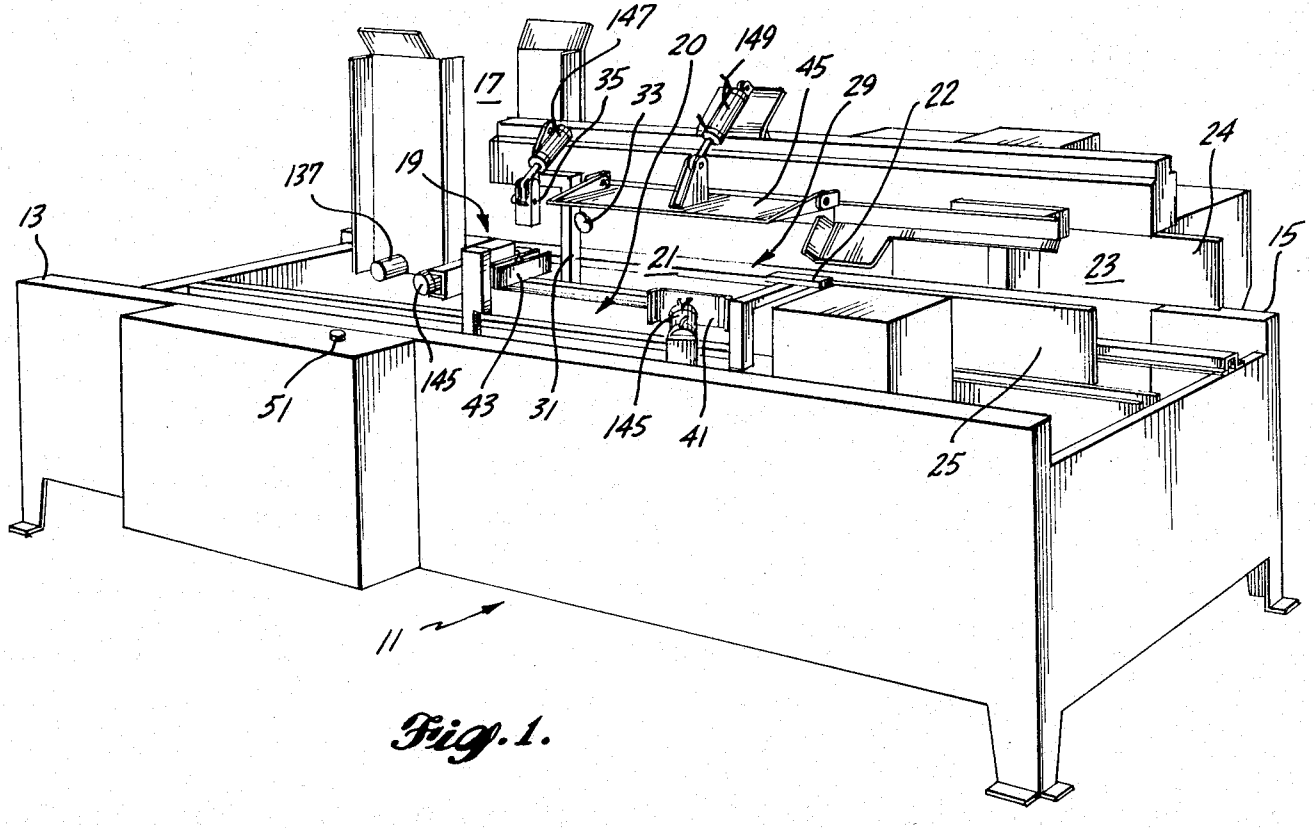
FIG. 1 is a pictorial diagram of the mechanical portion of a preferred embodiment of a programmable case set-up and bottom sealing machine formed in accordance with the invention.
Figure 1A:
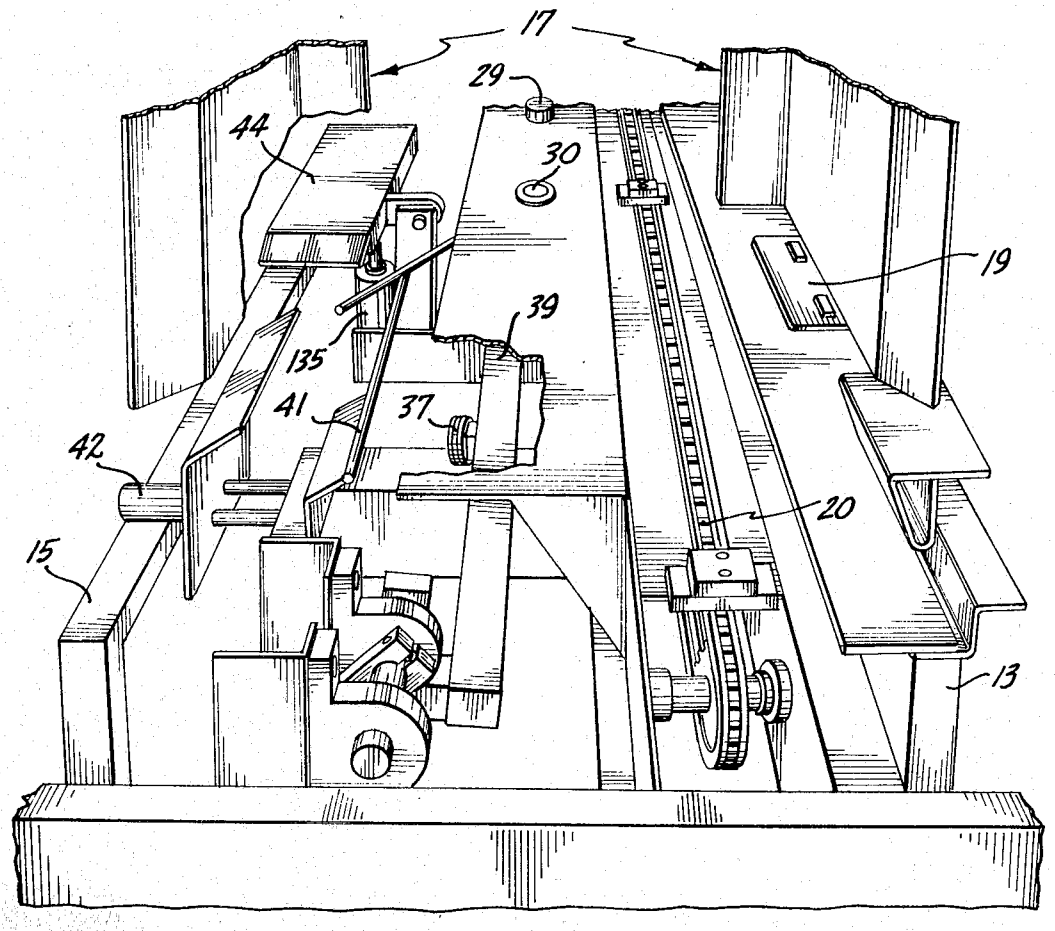
FIG. 1A is a partial pictorial diagram of the infeed or hopper end of the case set-up and bottom sealing machine illustrated in FIG. 1.

FIGS. 1 and 1A illustrate the mechanical portion of a programmable case set-up and bottom sealing machine formed in accordance with the invention. Because the mechanical portion illustrated in FIGS. 1 and 1A has been included in previously produced case set-up and bottom sealing machines, it will not be described in detail. Rather, only the general layout of the major elements will be described because such a description will make the overall nature and operation of the herein described programmable case set-up and bottom sealing machine more easily understood.

The mechanical portion of the preferred embodiment of a programmable case set-up and bottom sealing machine formed in accordance with the invention illustrated in FIG. 1 includes: a base 11 having a pair of parallel oriented sidewalls 13 and 15. The sidewalls 13 and 15 support various structural components (not shown in detail) that, in turn, support the various hereinafter described mechanical mechanisms that move, set-up and bottom seal a case. Located atop one end of the base 11 is a hopper 17. The hopper 17 houses a vertical stack of flattened (e.g., nonerected), horizontally oriented cases (not shown). The cases are dropped one at a time from the bottom of the stack in the hereinafter described manner by a shuttle mechanism 19 located beneath the hopper 17. The cases are received by a chain driven flight bar mechanism 20 and moved first to a case set-up station 21.

As each case reaches the case set-up station 21, as hereinafter described in more detail, the chain driven flight bar mechanism is stopped and the case is erected. After being erected, while still at the case set-up station, the upper bottom major flap is raised, and the bottom minor flaps of the case (which are located along the now vertical leading and trailing sides of the case) are folded inwardly. After the minor flaps have been folded inwardly, the upper bottom major flap is folded down. Thereafter, the case is moved from the case set-up station 21, past a glue head 22, to a mandrel station 23 by the chain driven flight bar mechanism 20. When the case reaches the mandrel station 23, the chain driven flight bar mechanism 20 is again stopped. Thereafter, a mandrel 24 moves into the case and presses the bottom minor and major flaps together and against a stop 25. The pressure seals the major flaps to the minor flaps. If the case is a Tab-Lok case, the bottom major and minor Tab-Lok flaps are folded down and the upper major and minor Tab-Lok flaps are foled up (see FIG. 2, view b) prior to case erection at the case set-up station.

Figure 2:
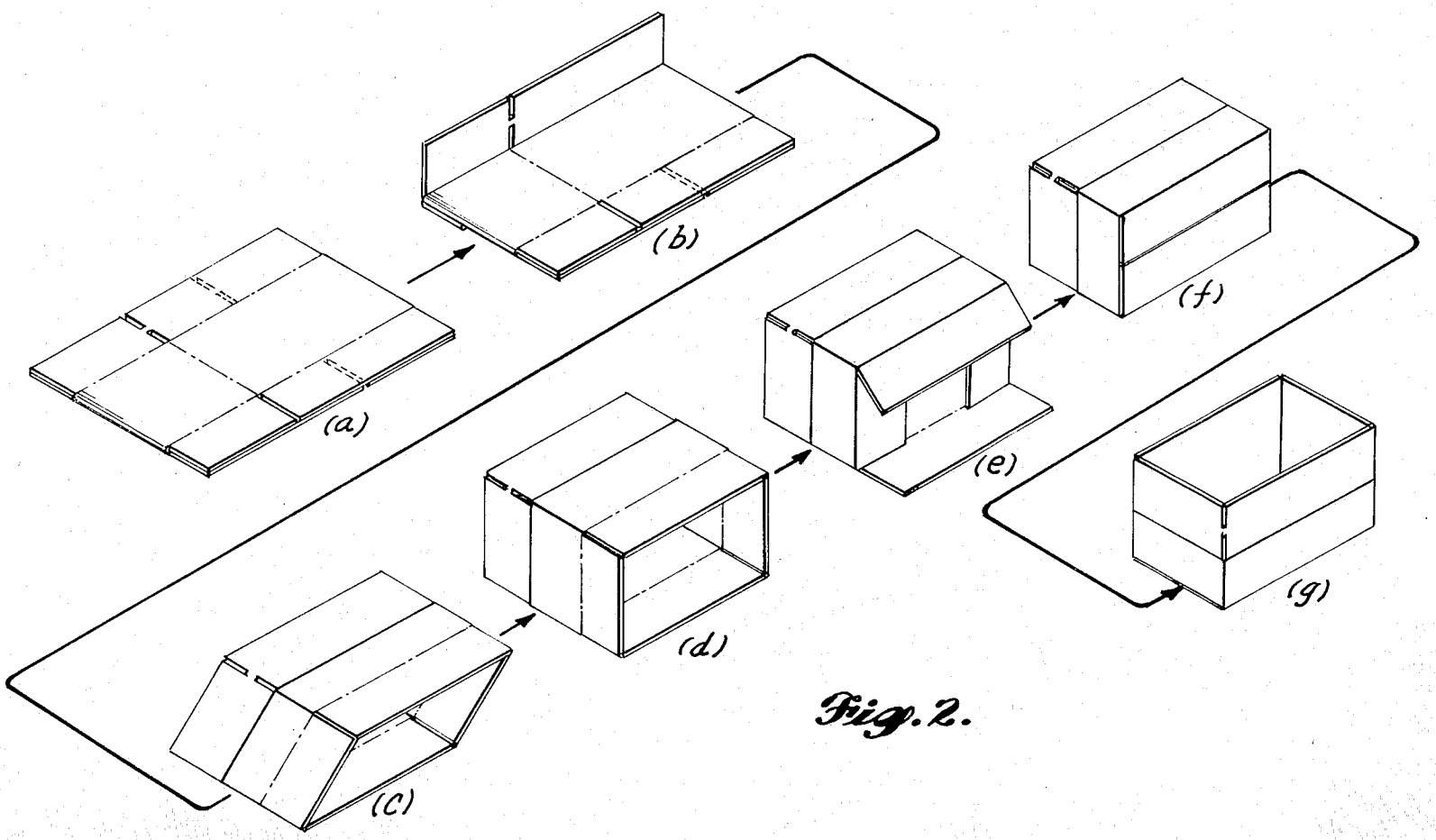
FIG. 2 is a sequential diagram illustrating the erection and sealing of a Tab-Lok case by a case set-up and bottom sealing machine.

As each case approaches the case set-up station 21, a case stop 29 is raised to halt movement of the case. At the same time, as noted above, the chain driven flight bar mechanism 20 is halted. The case stop 29 is included to precisely position the case and avoid any error caused by case inertial movement after the power applied to the chain driven flight bar mechanism temporarily ends. After the case stops, a bottom vacuum cup 30 is raised and grips the bottom of the flattened case. The "bottom" is gripped in the area of the downstream one of the two case sides forming part of the "bottom" of the flattened case. Next a case erect arm 31 located above the downstream edge of the flattened case rotates from a vertical position into a horizontal position, bringing a top vacuum cup 33 mounted on the outer end of the case erect arm into contact with the "top" of the flattened case. The contact point is located on the downstream one of the two sides of the case forming part of the "top" of the flattened case. After the top vaccum cup 33 grips the case, the case erect arm is rotated from its horizontal position back to the vertical position illustrated in FIG. 1. As the case erect arm 31 rotates in this manner, the case is erected as depicted in FIG. 2, views (c) and (d). After being erected, a lifter 35 is actuated to raise (or maintain raised) the upper bottom major flap of the erected carton. Thereafter, leading and trailing minor flap folders 41 and 43 are actuated to fold inwardly the leading and trailing flaps of the erected carton. Next, a major flap folder 45 is actuated to fold the upper bottom major flap down. Then, the holding force created by the bottom and top vacuum cups 30 and 33 is released and the erected carton is moved toward the glue head 22. As the carton is moved, the lower bottom major flap is folded up. When the case reaches the glue head 22, which passes through the slit between the edges of the upper and lower bottom major flaps, glue is applied to the flaps.

As noted above, after passng the glue head 22, the case is moved to the mandrel station 23 whereat, as previously described, a mandrel 24 moves into the case and presses bottom major and minor flaps against a stop 25. After a predetermined (programmable) compression time period has elapsed, the mandrel is withdrawn and the case is moved out of the mandrel station 23.

Figure 3:
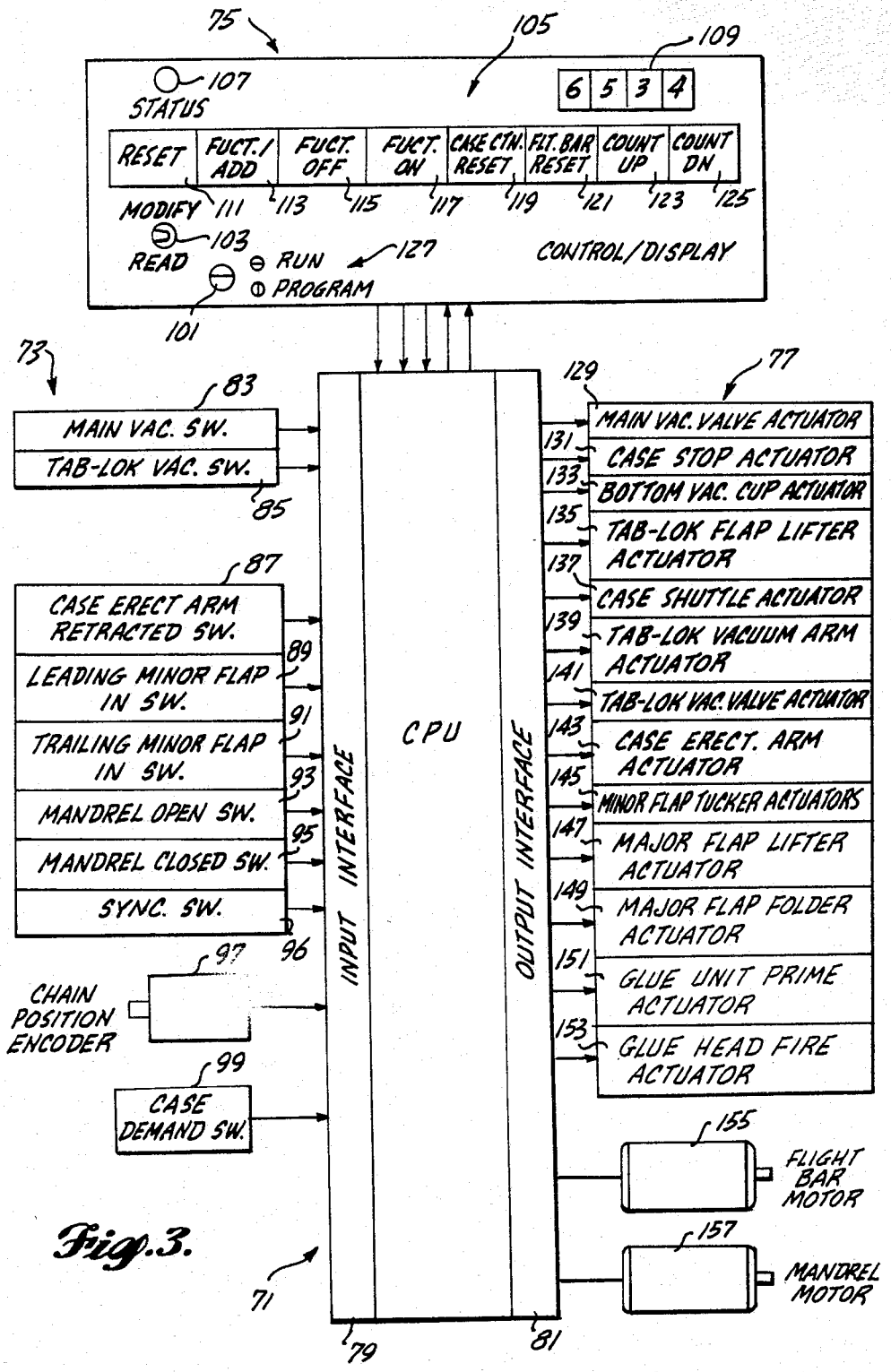
FIG. 3 is a block diagram illustrating a controller for a programmable case set-up and bottom sealing machine formed in accordance with the invention.

FIG. 3 is a block diagram of a controller suitable for use in a programmable case set-up and bottom sealing machine formed in accordance with the invention. The controller illustrated in FIG. 3 comprises: a central processing unit (CPU) 71; a plurality of input devices 73; a control/display unit 75; and, a plurality of controlled devices 77. In addition to a microprocessor, and a suitable memory and other required devices, the CPU also includes an input interface 79 and an output interface 81.

The input devices 73 include: a main vacuum sensing switch 83; a Tab-Lok vacuum sensing switch 85; a case erect arm retracted sensing switch 87; a leading minor flap in sensing switch 89; a trailing minor flap in sensing switch 91; a mandrel open switch 93; a mandrel closed switch 95; a sync switch 96; a chain position encoder 97; and, a case demand switch 99. The main and Tab-Lok vacuum sensing switches 83 and 85 are on/off or open/-closed switches whose state denotes the presence or absence of vacuum in the line being sensed. The main vacuum sensing switch 83 detects the occurrence of vacuum in a line connected to both the bottom and top vacuum cups 30 and 33. Both of these cups must be attached to a case in the manner described above before the main vacuum sensing switch 83 changes from a non-vacuum state to a vacuum state. If either cup is not attached, this switch remains in a non-vacuum state since air is being drawn into the nonattached cup. The Tab-Lok vacuum sensing switch detects the occurrence of vacuum in a line connecting the vacuum source to a Tab-Lok vacuum cup 37 mounted on a Tab-Lok vacuum arm 39 located beneath the hopper 17 (see FIG. 1A). The Tab-Lok vacuum arm 39 is raised by a suitable actuator (not shown in FIG. 1A) to bring the Tab-Lok vacuum cup into contact with the lower Tab-Lok flaps of a flattened case dropped by the shuttle 19 in the manner hereinafter described and, then, lowered to pull the flaps down. After the lower Tab-Lok flaps are folded down, they are maintained folded down by bracket 41 that is moved into position by a coacting actuator 42 as the Tab-Lok vacuum arm 39 is lowered. When the Tab-Lok vacuum arm 39 is raised, and the Tab-Lok vacuum cup 37 attaches to the bottom Tab-Lok flaps, the Tab-Lok vacuum sensing switch 85 switches from a non-vacuum state to a vacuum state.

The case erect arm retracted sensing switch 87 is positioned to sense when the case erect arm 31 is erect. More specifically, when the case erect arm is erect, the case erect arm retracted sensing switch 87 is in a first (retracted) state. When the case erect arm is not erect (i.e., the case erect arm is down, or being lowered or raised), the case erect arm retracted switch 87 is in a second state. While, preferably, the case erect arm retracted switch 87 is a mechanically actuated switch, it can take the form of a magnetic or optical switch, if desired.

The leading minor flap in sensing switch 89 is positioned to detect when the leading minor flap folder 41 is extended to fold the leading minor bottom flap of an erected case inwardly; and the trailing minor bottom flap in sensing switch 91 is positioned to detect when the trailing minor flap folder 43 is extended to fold the trailing minor bottom flap inwardly, in the manner herein described. As with the case erect arm retracted sensing switch, the leading and trailing minor flaps in sensing switches can take the form of mechanical switches, magnetic switches or optical switches, as desired.

The mandrel open and closed switches 93 and 95 are positioned to sense when the mandrel 24 is retracted (open) and extended (closed), respectively. While mechanical limit switches are preferred, the mandrel open and closed switches can take the form of magnetic or optical switches, if desired. The sync switch 96 is actuated by the chain driven flight bar mechanism 20. More specifically, the sync switch is positioned so as to close and open (and thus produce a sync pulse) each time a predetermined point on the chain driven flight bar passes a fixed location. While, preferably, the sync switch is a mechanical limit switch, it also can take the form of a magnetic or optical switch.

The chain position encoder 99 is connected to the chain driven flight bar mechanism 20 that moves cases from the hopper shuttle 19 to the case set-up station 21 and from the case set-up station 21 to the mandrel station 23. Each time the chain moves a predetermined incremental distance, the chain position encoder 99 produces a pulse. The pulses are counted and the count value utilized to control certain hereinafter described operations of the case set-up and bottom sealing machine. The case demand switch 99 is a manually controlled switch that can be actuated to temporarily halt the operation of the case set-up and bottom sealing machine. The case demand switch is designed for use in assembly line environment to halt the production of cases in order to avoid producing an oversupply for the assembly line.

The control/display unit 75 provides an operator interface to the CPU 71. The control/display unit includes: a run-program switch 101; a read-modify switch 103; a plurality of program keys 105; a status light 107; and, an alphanumeric display 109. The program keys 105 include: a reset key 111; a function/address key 113; a function off key 115; a function on key 117; a case count reset key 119; a flight bar reset key 121; a count-up key 123; and a countdown key 125. The run-program switch 101 is, preferably, a two-position key operated switch—the two positions are denoted the run position and the program position. When in the run position the run-program switch 101 places the case set-up and bottom sealing machine in a run mode of operation. In the program position the run-program switch places the machine in a program mode of operation. Preferably, a run-program switch display 127 is provided to show the key positions for the two modes of operation. The use of a key switch has the advantage of peventing unauthorized or inadvertent reprogramming of the programmable case set-up and bottom sealing machine. Preferably, the read-modify switch 103 is a two-position toggle switch that can be placed in either a read or a modify position. Preferably, the program keys 105 are momentary contact switches of the type utilized in a wide variety of electronic devices, such as calculators, keyboards, etc. The status light 107 is, preferably, a light emitting diode (LED) covered with a suitably colored (e.g., red) lens. Preferably, the alphanumeric display 109 is a four (4) character display suitable for displaying either letters or numbers, as required.

The devices 77 controlled by the CPU 71 include: a main vacuum valve actuator 129; a case stop actuator 131; a bottom vacuum cup actuator 133; a Tab-Lok flap lifter actuator 135; a case shuttle actuator 137; a Tab-Lok vacuum arm actuator 139; a Tab-Lok vacuum valve 141; a case erect arm actuator 143; minor flap tucker actuators 145; a major flap lifter actuator 147; a major flap folder actuator 149; a glue unit prime actuator 151; a glue head fire actuator 153; a flight bar motor 155; and, a mandrel motor 157. The main vacuum valve actuator 129 controls the application of vacuum to the bottom and top vacuum cups 30 and 33. The case stop actuator 131 controls the raising and lowering of the case stop 29. As described above, the case stop positions cases in the case set-up station. The bottom vacuum cup actuator 133 controls the raising and lowering of the bottom vacuum cup 30. As described above, the bottom vacuum cup is raised to a position whereat it can grip the bottom of a flattened case positioned in the case set-up station 21 prior to the case being erected. The Tab-Lok flap lifter actuator 135 controls the raising and lowering of a flap lifter, which, as shown in FIG. 1A, is a plate 44 positioned to lift the upper Tab-Lok flaps of a flattened case located in the case set-up station 21. The flap lifter lifts the upper Tab-Lok flaps to a position such that the upper Tab-Lok flaps overlie the adjacent sides of the case as illustrated in FIG. 2 when the case is erected.

The case shuttle actuator 137 controls the movement of the case shuttle 19, which slides the bottom flattened case in the hopper 17 to a position where it can drop onto the chain driven flight bar mechanism for movement to the case set-up position 21, as more fully described below. The Tab-Lok vacuum arm actuator 139 controls the raising and lowering of the Tab-Lok vacuum arm 39, and, thus, the Tab-Lok vacuum cup 37. The Tab-Lok vacuum valve actuator 141 controls the application of vacuum to the Tab-Lok vacuum cup 37.

The case erect arm actuator 143 controls movement of the case set-up arm 31 between the vertical position illustrated in FIG. 1 and the horizontal position whereat the top vacuum cup 33 grips the top of a flattened case located in the case set-up station 21, as heretofore described. The minor flap actuators 145 are, as shown in FIG. 1, actually two actuators that control movement of the leading and trailing minor flap folders 41 and 43 in and out. The major flap lifter actuator 147 controls the raising of the major flap lifter 35 and, thus, the upper major bottom flap of an erected case in the case set-up station 21, while the minor flap folders fold the minor bottom flaps inwardly. The major flap folder actuator 149 controls the raising and lowering of the major flap folders 45.

The glue unit prime actuator controls the priming of the glue head 22, which is required prior to actuation of the glue head. The glue head fire actuator, of course, controls the emission of glue by the glue head 22. The flight bar motor 155 is connected to and moves the chain of the chain driven flight bar mechanism 20 that moves cases from beneath the hopper to the case set-up station 21 and, then, to the mandrel station 23. The mandrel motor 157 moves the mandrel 24 in and out.

As illustrated in FIG. 3, the various sensing devices 73 are connected to the CPU via the input interface 79 and the various controlled devices 77 are connected to the CPU via the output interface 81.

As will be appreciated from the foregoing description, the programmable controller illustrated in block form in FIG. 3 includes a number of sensing devices. The information produced by the sensing devices in combination with the way the CPU is programmed by an operator via the control/display unit 75 controls the mode of operation of the programmable case set-up and bottom sealing machine. In essence, as will be better understood from the following description, the way the CPU is programmed and the information derived from testing the sensing devices controls the path taken during passes through a run subroutine forming part of the CPU program. That is, in operation, the CPU continuously makes passes through a program that has various subroutines, each of which has a number of branches. The path followed during each pass through the program (when the run-program switch 101 is in the run state) is determined by the state of the sensing devices 73 and the way the CPU is programmed. During programming, of course, the path followed is determined by the state of the read-modify switch 103 and the programming keys 105. The various paths or sequences of operation that can be followed are illustrated in flow diagram form in FIGS. 4–15 and next described.

Figure 4:
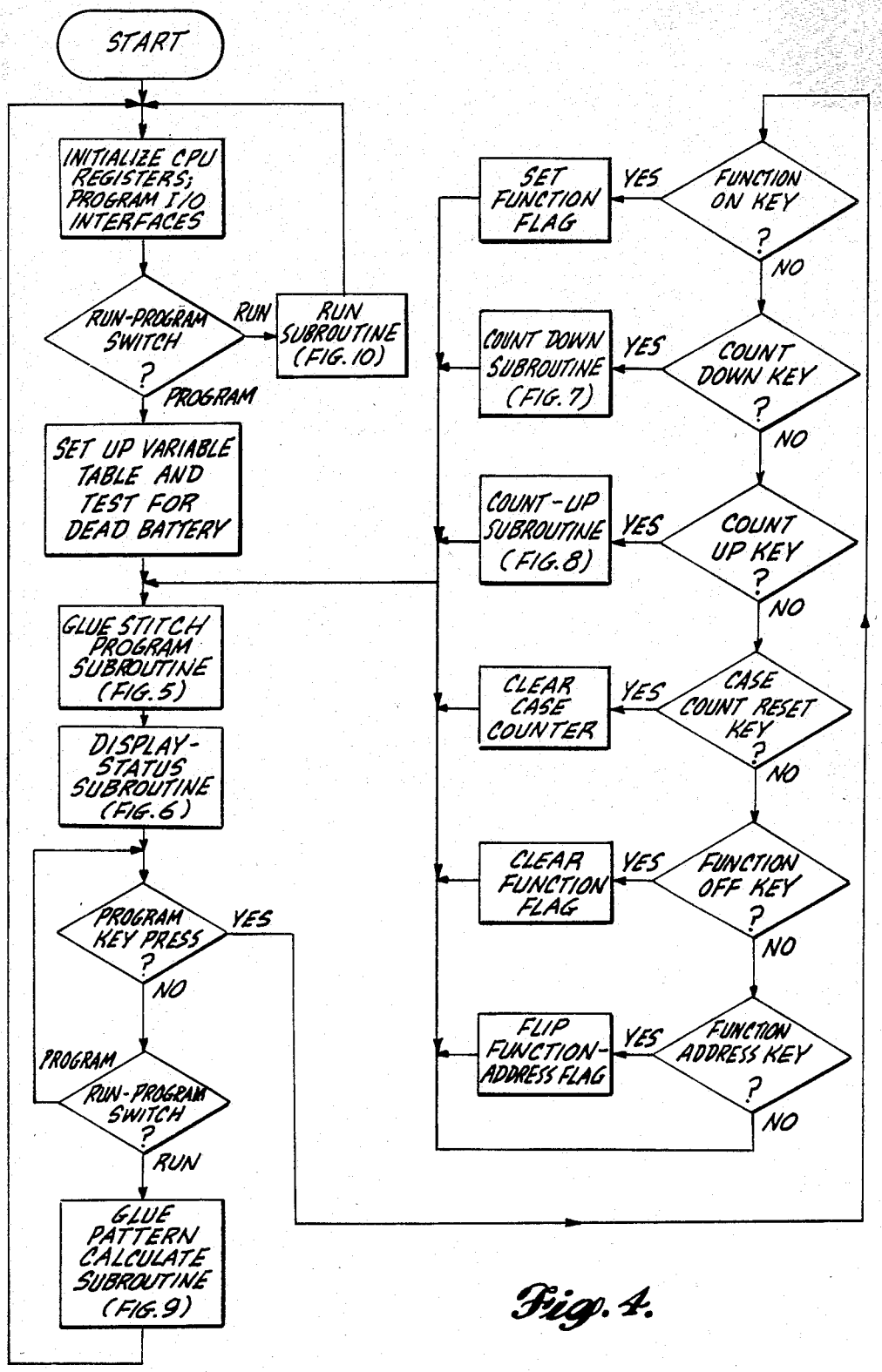
FIG. 4 is a flow diagram illustrating the main program (main sequence of operation) of the central processing unit (CPU) illustrated in FIG. 3.

FIG. 4 is a flow diagram illustrating the main program of a preferred embodiment of a programmable case set-up and bottom sealing machine formed in accordance with the invention. When power is applied to the machine or a power reset control switch 51 (FIG. 1) is actuated, the main program illustrated in FIG. 4 is entered. The first step in the main program is to initialize the CPU registers and program the input and output (I/O) interfaces 79 and 81 (FIG. 3). Interface programming involves setting up (e.g., programming) two input-/output circuits such that one functions as an input interface and the other functions as an output interface. In addition to programming the circuits such that one circuit functions as an input interface and the other as an output interface, the circuits are programmed to produce and acknowledge interrupts and function in other manners well known to those skilled in the microprocessor art. The input/output circuit programming steps are accomplished by reading instructions stored in a permanent memory such as a read-only memory (ROM) and acting accordingly.

After the input and output interfaces have been programmed, a test is made to determine the status of the run-program switch. If the run-program switch 101 is in the run position, a run subroutine illustrated in FIG. 10 and described below, is entered. If the run-program switch 101 is in the program position, a variable table is set up and a test is made to determine whether or not a battery used to refresh memory information in a temporary memory, such as a random access memory (RAM), is dead. The variable table is stored in the RAM. The table includes a section for each of the variable functions that can be programmed—case length, glue pattern length and mandrel compression time. Preferably, the first byte of each section identifies the function, the next byte (or bytes) identifies the maximum value of the function and the remaining byte (or bytes) stores the function value programmed by the operator in the manner hereinafter described.

Figure 5:
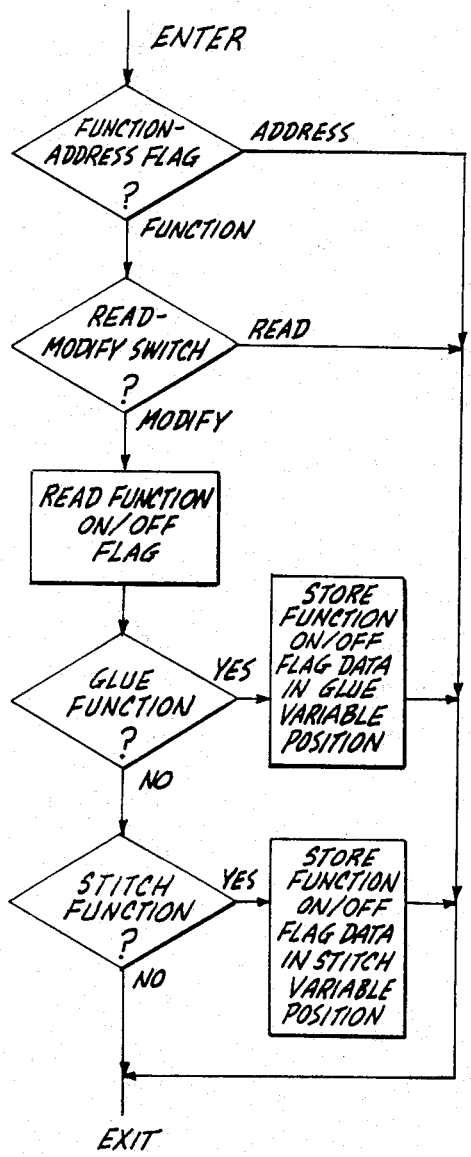
FIG. 5 is a flow diagram of a glue-stitch program subroutine suitable for inclusion in the sequence illustrated in FIG. 4.

After the variable table has been set up and the dead battery test performed, the glue-stitch program subroutine illustrated in FIG. 5 is entered. The first step in the glue-stitch program subroutine is a test to determine the status of a functionaddress flag toggled by the function-address key 113 in the manner hereinafter described. If the function-address flag is in the address state, the other steps of the glue-stitch program subroutine are bypassed and the sequence of operation of the programmable case set-up and bottom sealing machine cycles to the display-status subroutine illustrated in FIG. 6 and described below. If the function-address flag is in the function state, a test of the read-modify switch 103 is made. If the read-modify switch is in the read state, the other steps of the glue-stitch program subroutine are again bypassed and the sequence of operation cycles to the display-status subroutine. If the read-modify switch 103 is in the modify state, the status of a function on/off flag programmed in the manner hereinafter described is read. Then a test is made to determine whether or not the particular function being modified is the glue function. This test is made by reading the status of a function counter that is incremented and decremented in the manner hereinafter described. If the counter is set at a value that identifies the glue function, the glue function test is positive and the status of the function on/off flag is stored in the glue variable position of the RAM. More specifically, the RAM includes a position (memory bin) that stores a bit of information that is used to determine if glue is or is not to be applied as a case passes the glue head 22. For example, if the bit is high, glue will be applied and if the bit is low, glue will not be applied. This bit is programmed by setting (or clearing) the function on/off flag in the manner described below and, then, later reading and storing the set or clear value in the glue variable RAM position during a pass through the glue-stitch program subroutine in the manner just described. After the state of the function on/off flag has been stored in the glue variable position in the RAM, the sequence of operation cycles to the display-status subroutine.

Figure 6:
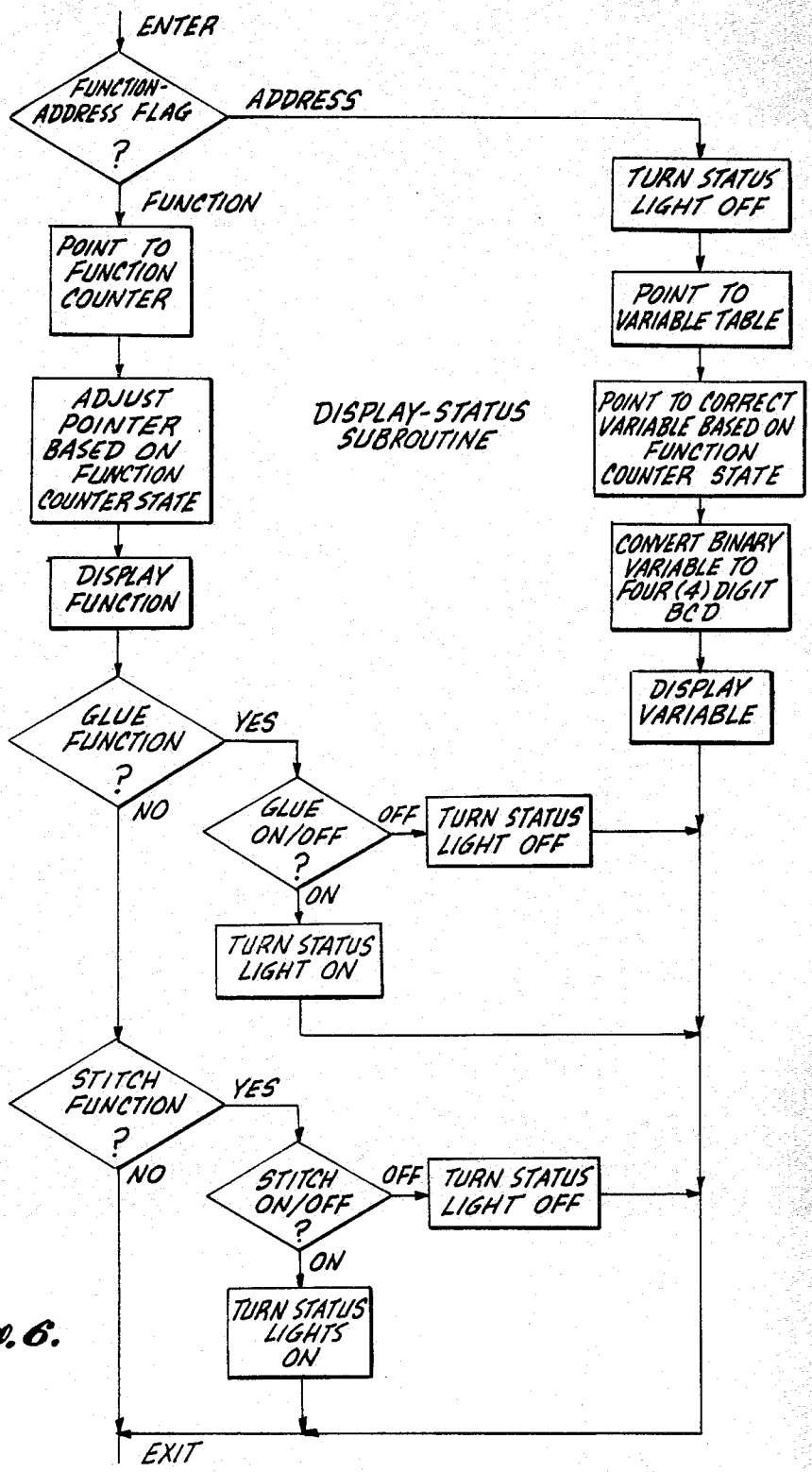
FIG. 6 is a flow diagram of a display-status subroutine suitable for inclusion in the sequence illustrated in FIG. 4.

If the function counter value was not set at the glue function, a test is made to determine if the function counter is set at a value that identifies the stitch function. If the function counter value is the stitch function, the state of the function on/off flag is read and stored in a stitch variable position in the RAM in the same manner as the state of the function on/off flag is stored in the glue function position in the RAM. Thereafter, the sequence of operation cycles to the display-status subroutine. If the function counter is not set at the stitch function, the sequence of operation also cycles to the display-status subroutine. After a pass through the glue-stitch program subroutine following one of the paths just described is completed, the display-status subroutine illustrated in FIG. 6 is entered.

The first step in the display-status subroutine is a test of the status of the function-address flag. If the function-address flag is in the function state, the program "points" to the function counter. As noted above, the state of the function counter relates to a programmable machine function. In the preferred embodiment of the programmable case set-up and bottom sealing machine hereinafter described, there are five programmable functions, all of which have been referred to above. They are the glue function, the stitch function, the case length function, the glue pattern length function and the compression time function. The first two functions (e.g., the glue and stitch functions) are on/off functions. The latter three functions (e.g., the case length, pattern length and compression time functions) are numerical value functions. In any event, because there are five programmable functions, the function counter can be set to any one of five possible numerical states-0, 1, 2, 3 and 4.

After the program "points" to the function counter, the program "points" to a display bin in permament memory based on the state of the function counter. The permanent memory, which may be in the form of a ROM or a variation thereof, such as a programmable read-only memory (PROM) or an erasable programmable read only memory (EPROM), stores in the pointed to bin data suitable for creating a display of the function defined by the function counter value, such as GLUE for glue function, STCH for stitch function, PATL for pattern length, BOXL for case (or box) length, and COMP for the compression time.

After the command to display the pointed to function has occurred, a test is made to determine whether or not the function is the glue function. If the function is the glue function, a test is made of the glue variable position in the RAM to determine if the glue function is programmed on or off. If the glue function is programmed off, the status light 107 is turned off (or commanded to remain off if it was off). Thereafter, the program leaves the display-status subroutine and cycles to a program key press test in the main program illustrated in FIG. 4 and described below. Contrariwise, if the glue function is programmed on, the status light is turned on (or commanded to remain on) and, then, the display-status subroutine terminates and the sequence of operation cycles to the point in the main program illustrated in FIG. 4 where the hereinafter described program key press test occurs.

If the glue function test is negative, a test is made of the stitch variable position in the RAM to determine if the stitch function is programmed on or off. If the stitch function is programmed off, the status light is turned off (or commanded to remain off) and the sequence of operation cycles to the point in the main subroutine illustrated in FIG. 4 where the program key press test occurs. If the stitch function is programmed on, the status light is turned on (or commanded to remain on) and, then, the sequence of operation cycles to the point in the main program where the program key press test occurs. Finally, if the stitch function test is negative, the display-status subroutine terminates and the sequence of operation cycles to the point in the main program subroutine illustrated in FIG. 4 where the program key press test occurs.

If the function-address flag test that occurs when the display-status subroutine is entered determines that the function-address flag is in the address state, the path illustrated on the right side of FIG. 6 is followed. The first step in this path is to turn off the status light (or command the status light to remain off). The status light is turned off because the status light state is related only to the stitch and glue functions and the information to be displayed when the right path is followed relates to the functions programmed with a numerical value—the pattern length function, the case length function or the compression time function. After the status light is turned off, the program points to the variable table. (As noted above, the variable table contains the programmed numerical data for the pattern length, case length and compression time functions). Thereafter, the program adjusts the pointer to point to the correct variable based on the function counter value. Thereafter, the programmed value of the "pointed to" variable is read out and converted from binary form to four (4) digit binary coded decimal (BCD) form. The BCD value is then used to create a decimal display of the programmed value of the "pointed to" variable. As described below, the programmed values are changed, i.e., incremented and decremented during passes through the countdown and count-up subroutines illustrated in FIGS. 7 and 8. After the programmed value has been displayed, the display-status subroutine terminates and the sequence of operation cycles to the point in the main program illustrated in FIG. 4 where the program key press test takes place.

After a pass throught the display-status subroutine (FIG. 6) has occurred, as illustrated in FIG. 4, the program key press test is made. The program key press test is a test of all of the program keys 105 to determine if any key is being actuated (e.g., pressed). If a program key is being pressed, sequential tests are made to determine which one of certain ones of the program keys are pressed. If one of the keys is pressed, the action commanded by the actuated key occurs. The key tests and the actions that occur are illustrated on the right side of FIG. 4.

First, a test is made to determine whether or not the function on key is pressed. If the function on key is pressed, the function flag is set. Thereafter, the main program cycles to the point where the glue-stitch program subroutine is entered. If the function on key is not pressed, a test is made to determine whether or not the countdown key is pressed. If the countdown key is pressed, the countdown subroutine illustrated in FIG. 7 is entered.

Figure 7:
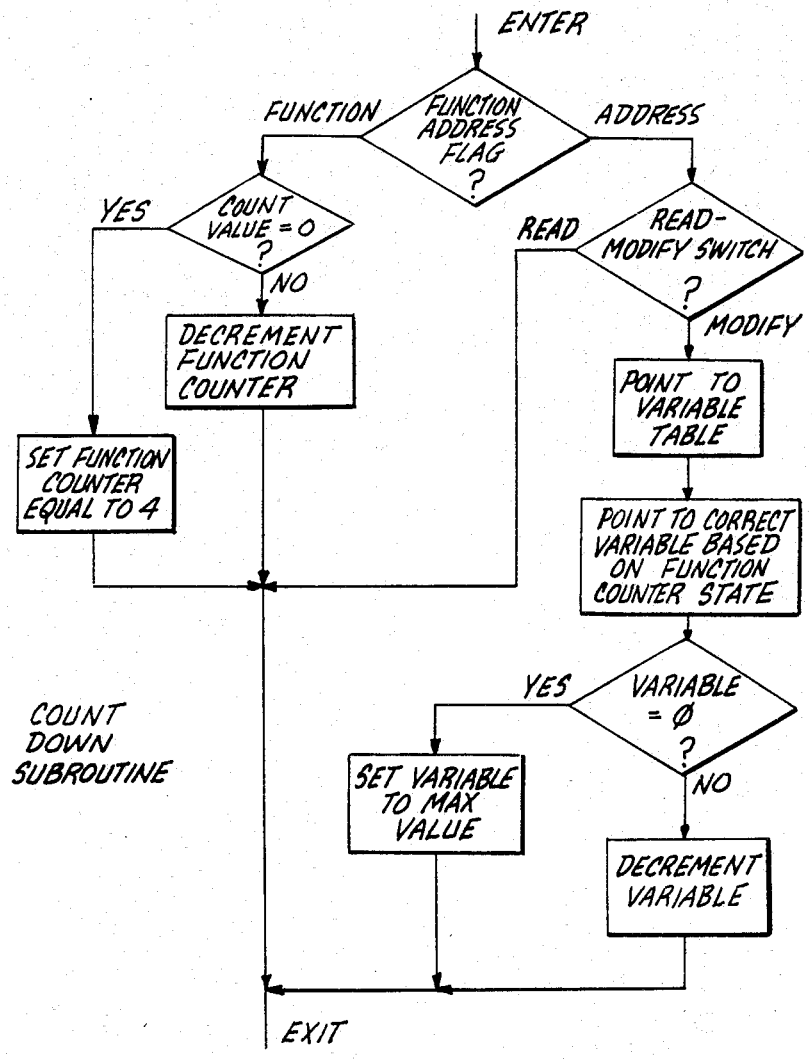
FIG. 7 is a flow diagram of a countdown subroutine suitable for inclusion in the sequence illustrated in FIG. 4.
Figure 8:
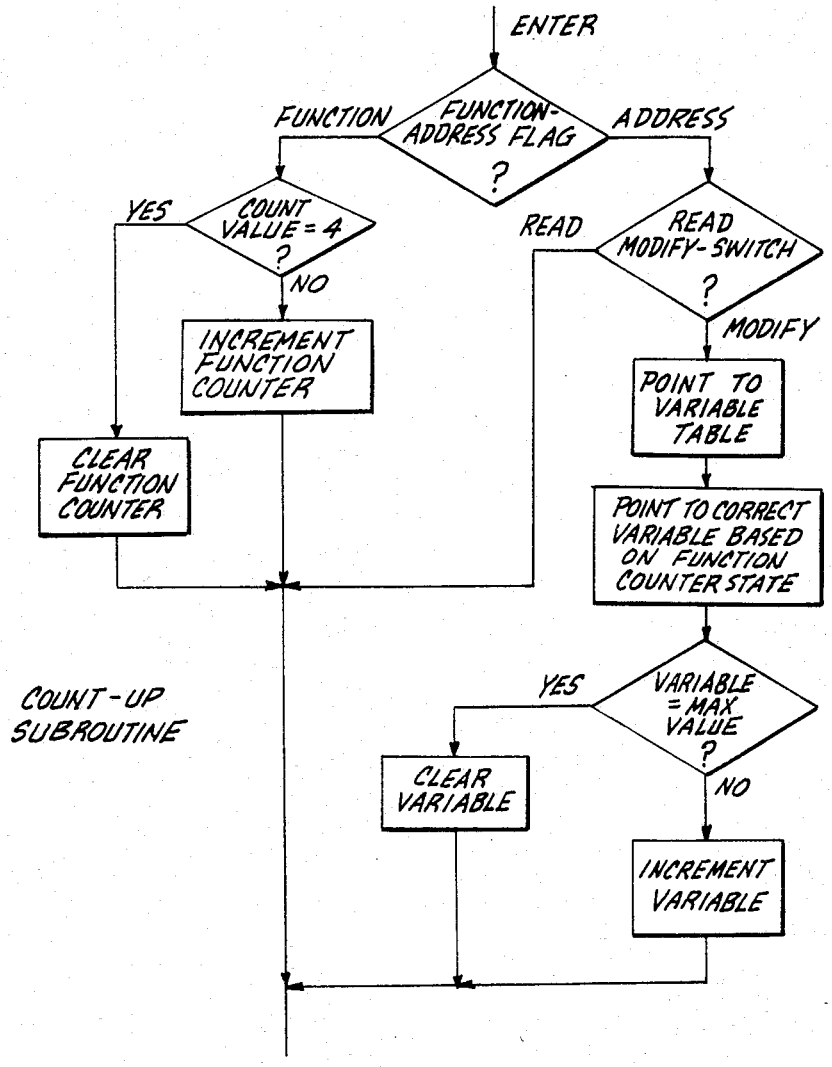
FIG. 8 is a flow diagram of a count-up subroutine suitable for inclusion in the sequence illustrated in FIG. 4.

The first step in the countdown subroutine illustrated in FIG. 7 is a test of the function-address flag. If the function-address flag is in the function state, a test is made to determine whether or not the count value of the function counter is equal to zero. If the value of the function is not equal to zero, the function counter is decremented. Thereafter, the countdown subroutine terminates and the sequence of operation cycles to the point where the glue-stitch program subroutine is entered, as illustrated in FIG. 4. If the status of the function counter is less than zero, the function counter is set equal to four (4). Thereafter, the countdown subroutine ends and the sequence of operation cycles to the point in the main program where the glue-stitch program subroutine is entered. (As noted above, the function counter maximum numerical value is four because the herein described preferred embodiment of a case set-up and bottom sealing machine formed in accordance with the invention has five functions. This, of course, is the reason the function counter is set equal to four.)

If the function-address flag is in the address state when the countdown subroutine is entered, the state of the read-modify switch is tested. If the read-modify switch is in the read position, the countdown subroutine ends and the sequence of operation cycles to the point in the main program where the glue-stitch program subroutine is entered. If the read-modify switch is in the modify position, the program "points" to the variable table. Thereafter, the program points to the correct variable based on the status of the function counter. Then, the programmed value of the variable is tested to determine whether or not it is equal to zero. If the programmed value of the "pointed to" variable is not equal to zero, the programmed value is decremented and the result becomes a new programmed value for the "pointed to" variable. If the programmed value is equal to zero, the programmed value is set equal to the maximum value, which was read from permanent memory and stored in the variable table when that table was set up as previously described. Thereafter, the countdown subroutine ends and the sequence of operation cycles to the point in the main program where the glue-stitch program subroutine is entered.

If the countdown key is not pressed when the countdown key test takes place, then, as shown in FIG. 4, a test of the count-up key is made to determine whether or not the count-up key is pressed. If the count-up key is pressed, a count-up subroutine (illustrated in FIG. 8) is entered.

The first step in the count-up subroutine is a test of the function-address flag. If the function-address flag is in the function state, the function counter is tested to determine whether or not its value is equal to four (4). If equal to four (4), the function counter is cleared, i.e., set equal to zero. If not equal to four (4), the function counter is incremented. After the function counter has been tested and changed, the count-up subroutine ends and the sequence of operation cycles to the point in the main program where the glue-stitch program subroutine is entered.

If the state of the function-address flag is the address state when the count-up subroutine is entered, the read-modify switch is tested. If the read-modify switch is in the read position, the count-up subroutine ends and the sequence of operation cycles to the point in the main program where the glue-stitch program subroutine is entered. If the read-modify switch is in the modify position, the program "points to" the variable table and, then, to the correct variable based on the state of the function counter. If the function counter state is the pattern length state, the pattern length variable is pointed to; if the function counter state is the case length state, the case length variable is pointed to; or if the function counter state is the compression time state, the compression time variable is pointed to. The glue or stitch function counter states point to no variables since none exist. After the correct variable is pointed to, the programmed value for that variable is tested to determine if it is equal to the maximum value for that variable. If the programmed value is equal to the maximum value, the programmed value is cleared, i.e., set equal to zero. Alternatively, if the programmed value is not equal to the maximum value, the programmed value is incremented. The incremented value then forms a new programmed value. After the programmed value has been cleared or incremented, the count-up subroutine ends and the sequence of operation cycles to the point in the main program where the glue-stitch program subroutine is entered, as illustrated in FIG. 4.

If the count-up key 123 test determines that the count-up key is not being pressed, a test is made to determine if the case count reset key is being pressed. If the case count reset key is being pressed, a case counter (which is incremented each time a case is set up when the machine is in the run mode of operation, as hereinafter described) is cleared. After the case counter is cleared, the sequence of operation cycles to the point where the glue-stitch program subroutine is entered.

If the case count reset key is not being pressed, a test is made to determine if the function off key is being pressed. If the function off key is being pressed, the function flag is cleared and the sequence of operation cycles to the point where the glue-stitch subroutine is entered, as illustrated in FIG. 4. If the function off key is not being pressed, a test is made to determine if the function-address key is being pressed. If the functionaddress key is being pressed, the function-address flag is toggled, i.e., changed from the function state to the address state or from the address state to the function state. After the function-address flag has been toggled, or if the function-address key test is negative, the sequence of operation cycles to the point where the glue-stitch program subroutine is entered.

Figure 9:
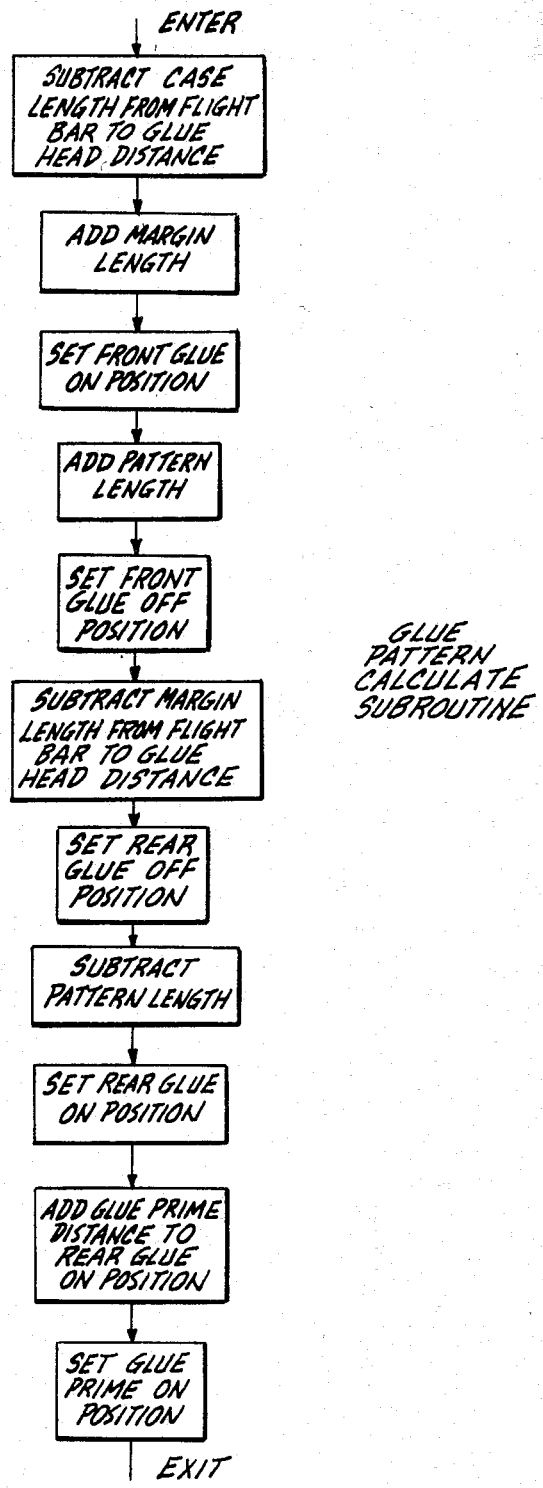
FIG. 9 is a flow diagram of a glue pattern calculate subroutine suitable for inclusion in the sequence illustrated in FIG. 4.

Turning now to the portion of the main program illustrated in the lower left-hand corner of FIG. 4, if the program key press test is negative, i.e., no key is being pressed, a test of the run-program switch 101 is made. If the run-program switch is in the program position, the main program cycles back to the point where the program key press test is made. This loop is repeated until a program key is pressed or the run-program switch 101 is shifted to the run position. When the test of the run-program switch 101 determines that the switch has been shifted to the run position, the wait loop just described is left and the glue pattern calculate subroutine illustrated in FIG. 9 is entered.

The first step in the glue pattern calculate subroutine is subtracting the programmed case length from the flight bar to glue head distance. The flight bar to glue head position is the distance between a flight bar impinging on the rear lower corner of a case stopped by the stop 29 at the case set-up position 21 and the glue head. The result of this subtraction step is the distance between the leading side of of an erected case located at the case set-up station 21 and the glue head. The next step of the glue pattern calculate subroutine is to add a margin length value to the result of the subtraction step. The margin length value is the distance between the leading edge of the case and the point on the case bottom where glue is to first be applied. The margin length value is a predetermined value stored in the permanent memory of the programmable case set-up and bottom sealing machine. The result of this addition step establishes the glue front on position, which is stored in the RAM for use during the run subroutine in the manner hereinafter described.

The next step in the glue pattern calculate subroutine is to add the programmed pattern length of the glue front on position value to determine the front glue off position, which is also stored in the RAM for use during the run subroutine. Next, the margin length is subtracted from the flight bar to glue head distance. This subtraction determines the off position of the second of two glue on/off patterns. The resultant or rear glue off position is also stored in the RAM for use during the run subroutine. Next, the pattern length is subtracted from the second glue off position. This result is a second or rear glue on position, i.e., the position at which the rear glue pattern is to start. This position is also stored in memory for use during the run subroutine. Finally, because the glue head must be primed prior to emitting glue, the required prime time (in terms of distance—three inches, for example) is added to the rear glue on position to determine the prime on position for the rear glue pattern. As will be understood from the following discussion of the transfer subroutine which forms part of the run subroutine, the prime on position for the front glue pattern occurs when a case begins moving from the case set-up station to the mandrel station. In any event, the calculated prime on position for the rear glue pattern is also stored in the RAM for use during the run subroutine. Thereafter, the glue pattern calculate subroutine ends and the program cycles to the point where the main program subroutine is entered, as illustrated in FIG. 4.

Figure 10:
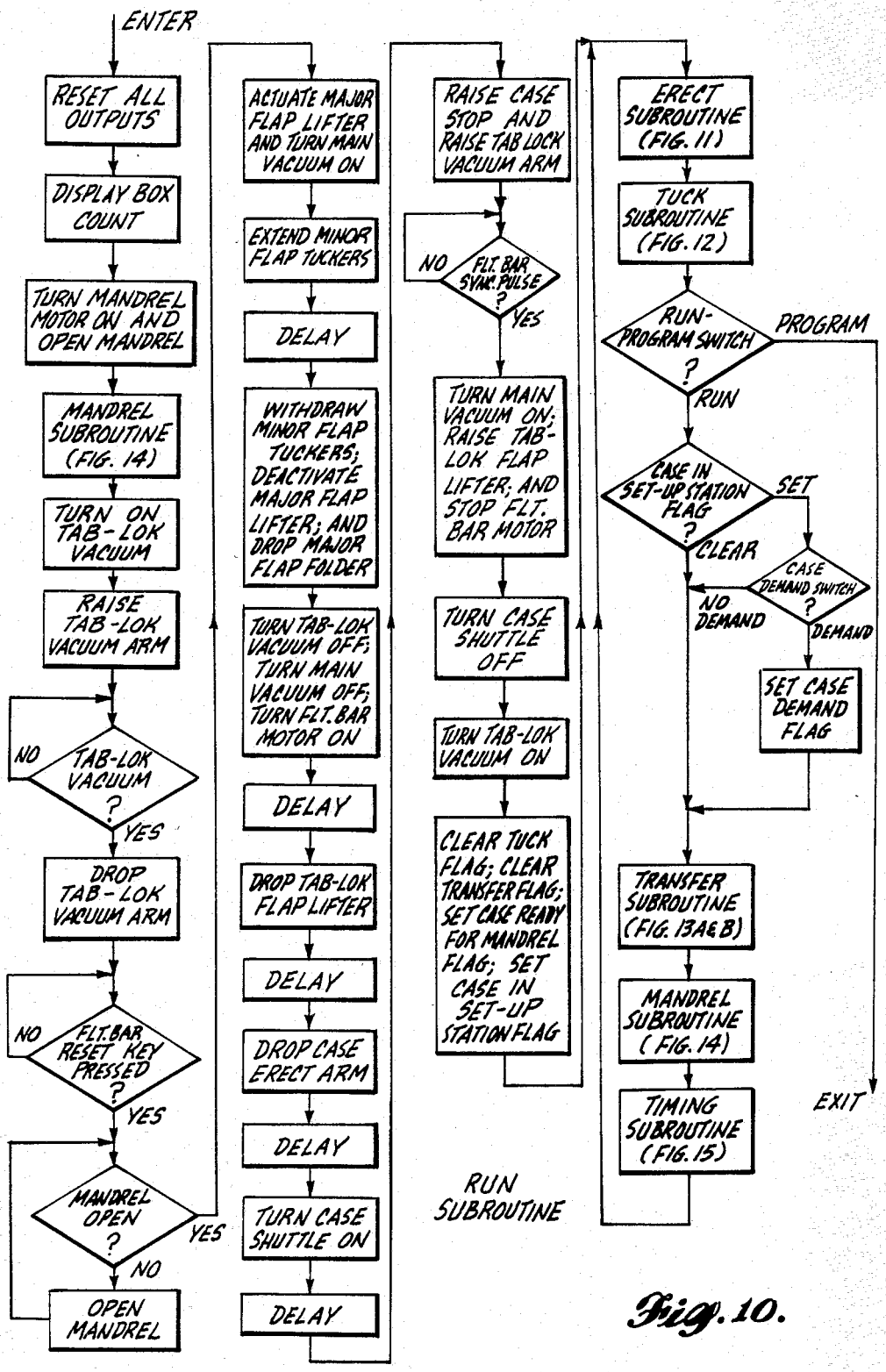
FIG. 10 is a flow diagram of a run subroutine suitable for inclusion in the sequence illustrated in FIG. 4.

Turning now to the run subroutine illustrated in FIG. 10; as discussed above, the run subroutine is entered when the run-program switch test illustrated in the upper left-hand corner of FIG. 4 determines that the run-program switch 101 is in the run position. The first step in the run subroutine is to reset all outputs of the output interface 81 to a nonactuate status. Next, the box count value stored in the box counter is displayed. If, as discussed above, the box count reset switch has been pressed, the initial box count value displayed is zero. Next, the program subroutine goes through a series of steps designed to synchronize the operation of the case set-up and bottom sealing machine and to complete the setting up and bottom sealing of any case in the machine at the time the run subroutine is entered. This series of steps is necessary because the chain driven flight bar mechanism 20 can be in any position when the machine is started. Moreover, a case or cases could be located in any position or positions—in the shuttle, between the shuttle and the case set-up station, in the case set-up station (either flat or erect), between the case set-up station and the mandrel station, or in the mandrel station. The only requirement prior to entering the run subroutine is that a case be preloaded into the bottom of the hopper (i.e., beneath the shuttle 19). If no case is preloaded, the initial or synchronization steps cannot be completed. After the synchronization steps are complete, the program subroutine enters a loop shown on the right side of FIG. 10 during which boxes are sequentially set up and bottom sealed (if glue is to be applied) as long as the run-program switch remains in the run position and the case demand switch is in a demand state.

After the box count display step has occurred, the mandrel motor is turned on and the mandrel is opened. Next, a pass through the mandrel subroutine illustrated in FIG. 14 and hereinafter described occurs. In essence, this pass causes the bottom major and minor flaps of a case to be compressed if a case is located in the mandrel station. As will be better understood from the following description of the mandrel subroutine, when this subroutine is complete, the mandrel is open.

After the pass through the mandrel subroutine the Tab-Lok vacuum valve 141 is closed to apply vacuum to the Tab-Lok vacuum cup 37. Then, the Tab-Lok vacuum arm 39 is raised so that the Tab-Lok vacuum cup 37 can attach itself to the Tab-Lok flaps of the case that was preloaded into the bottom of the hopper. The run program subroutine then cyclically tests the Tab-Lok vacuum switch 85 until the Tab-Lok vacuum cup 37 grips the bottom Tab-Lok flaps of the flattened case. As noted above if a case is not preloaded into the bottom of the hopper, the Tab-Lok vacuum cup 37 has nothing to grip and, thus, the Tab-Lok vacuum test is never passed. After Tab-Lok vacuum cup attachment occurs, the Tab-Lok vacuum arm 39 is dropped. This action pulls the bottom Tab-Lok flaps of the flattened case down. As the Tab-Lok vacuum arm 39 drops, the bracket 41 is moved into a position by the bracket actuator 42 to further fold the bottom Tab-Lok flaps and hold these flaps in their folded configuration after Tab-Lok vacuum is turned off (as occurs later in the present sequence as described below) and the case is moved to the case set-up station.

After the Tab-Lok vacuum arm drop command occurs, the flight bar reset key 121 on the control/display unit is tested to determine if that key is being pressed. The run mode of operation continuously repeats this test until the flight bar reset key is pressed.

After the flight bar reset key is pressed, a test is made of the mandrel open switch 93 to determine if the mandrel 24 is open. This is a back-up test since the mandrel should be open either as a result of the mandrel open command that occurred at the beginning of the run subroutine or as a result of the earlier pass through the mandrel subroutine. If the mandrel 24 is not open, a mandrel open command occurs and the mandrel motor 137 is energized to open the mandrel. Thereafter, the mandrel open test reoccurs. This sequence of operation continues until the mandrel open switch 93 denotes that the mandrel is open.

After the mandrel open test is passed, the major flap lifter 35 is actuated and the main vacuum is turned on. The actuation of the major flap lifter 35 lifts the flap of an erected case in the case set-up station if an erected case is in that station when the run subroutine is entered. The turning on of the main vacuum applies vacuum to the bottom and top cups 30 and 33. Next, the minor flap tuckers 41 and 43 are extended to tuck the flaps of the erected case (if one is present in the case set-up station) after which a delay occurs. After the delay, which is adequate for the minor flap tuckers to be fully extended (1.2, sec, for example), the minor flap tuckers 41 and 43 are withdrawn. At the same time, the major flap lifter 35 is deactivated and the major flap folder 45 is dropped. Next, the Tab-Lok vacuum and the main vacuum are turned off, and the flight bar motor is turned on. When the flight bar motor is turned on the chain driven flight bar mechanism moves the preloaded case from beneath the hopper to the case set-up station and the erected and tucked case (if one was present) from the case set-up station to the mandrel station. The bottom Tab-Lok flaps of the flattened case remain folded back because while the Tab-Lok vacuum is turned off the Tab-Lok vacuum arm 39 remains down whereby its associated bracket 41 maintains the bottom Tab-Lok flaps folded.

After a short (i.e., 115 msec.) delay, which occurs after the flight bar motor is turned on, the Tab-Lok flap lifter 44 is dropped. As shown in FIG. 1A and briefly described above, the Tab-Lok flap lifter is a plate that is positioned (when dropped) to support the upper Tab-Lok flaps of a flattened case as the case moves into the case set-up station. When raised, the Tab-Lok flap lifter 44 folds the upper Tab-Lok flaps to a position such that they will overlie the top and trailing sides of a case as the case is erected at the case set-up station. After another short (i.e., 215 msec.) delay, the case erect arm 31 is dropped. As these actions take place, i.e., dropping the Tab-Lok flap lifter 44 and the case erect arm 39, the preloaded case is moved by the chain driven flight bar mechanism 20 away from the bottom of the hopper 17.

After a further somewhat longer (i.e., 0.5 sec.) delay, the case shuttle 19 is turned on. This action slightly slides the bottom case in the hopper to a position above the chain driven flight bar mechanism 20. After a short (i.e., 0.11 sec.) delay, the case stop 29 is raised. At the same time, the Tab-Lok vacuum arm 39 is raised to a point where the Tab-Lok vacuum cup 37 can grip the bottom Tab-Lok flaps of the case held above the chain driven flight bar mechanism by the case shuttle 19 when the case is dropped and Tab-Lok vacuum is reapplied. After the Tab-Lok vacuum arm has been raised, the run program cycles until a flight bar sync pulse is produced as the heretofor noted predetermined point on the chain driven flight bar mechanism 20 passes the sync switch 96. After a flight bar sync pulse is detected, the main vacuum is turned on and the Tab-Lok flap lifter 44 is raised. Further, the flight bar motor is stopped. As will be understood from this description the sync pulse occurs just as a case reaches the case set-up station, since the flight bar motor is stopped. Any positioning error resulting from case inertia, after power to the chain driven flight bar mechanism 20 ends, is avoided by the raised case stop 29 impinging on the leading edge of the flattened case.

Next, the case shuttle is turned off and the Tab-Lok vacuum is turned on. When the case shuttle is turned off the previously shuttled case is dropped onto the chain driven flight bar mechanism and has its lower Tab-Lok flaps gripped by the Tab-Lok vacuum cup 37. After Tab-Lok vacuum has been turned on, a tuck flag is cleared, a transfer flag is cleared, a box ready for mandrel flag is set and a case is set-up station flag is set.

At this point is will be appreciated that an erected case, if one was in the case set-up station when the run program was entered, has had its minor bottom flaps tucked, its upper major bottom flap folded and been moved to the mandrel station. Further, a case has been moved from beneath the hopper 17 to the case erect station 21. The latter case is now ready to be erected. Also another flattened case has been dropped onto the chain driven flight bar mechanism 20. Finally, and most importantly, movement of the chain driven flight bar mechanism is synchronized. The run subroutine now enters the loop illustrated on the right side of FIG. 10 and remains in this loop until the run-program switch is shifted to the program position. During each cyclical pass through this loop, the program follows paths determined by the state of the various switches and by flags that are set and cleared as various case erection, movement and sealing functions occur.

Figure 11:
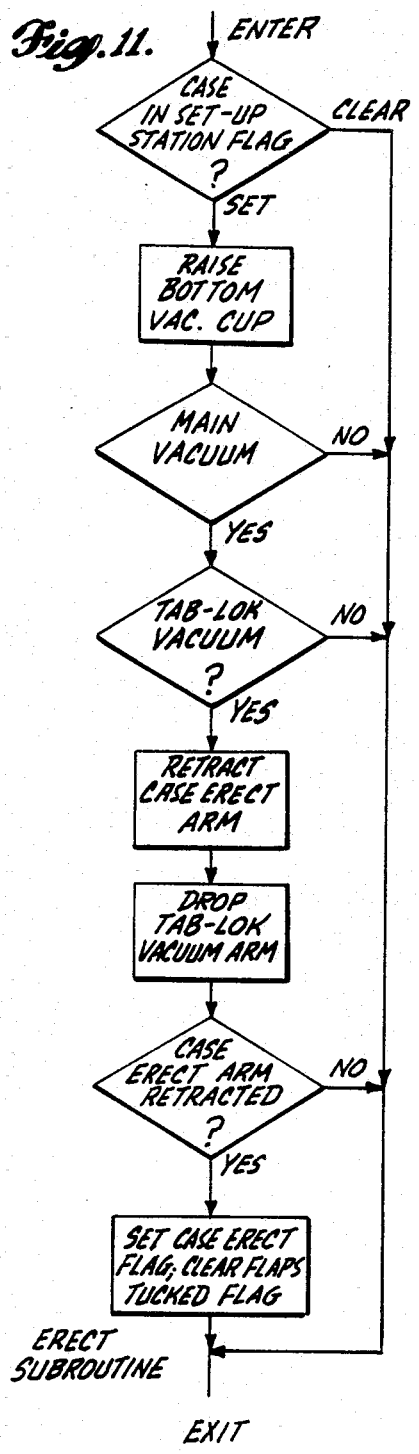
FIG. 11 is a flow diagram of an erect subroutine suitable for inclusion in the run subroutne illustrated in FIG. 10.
Figure 12:
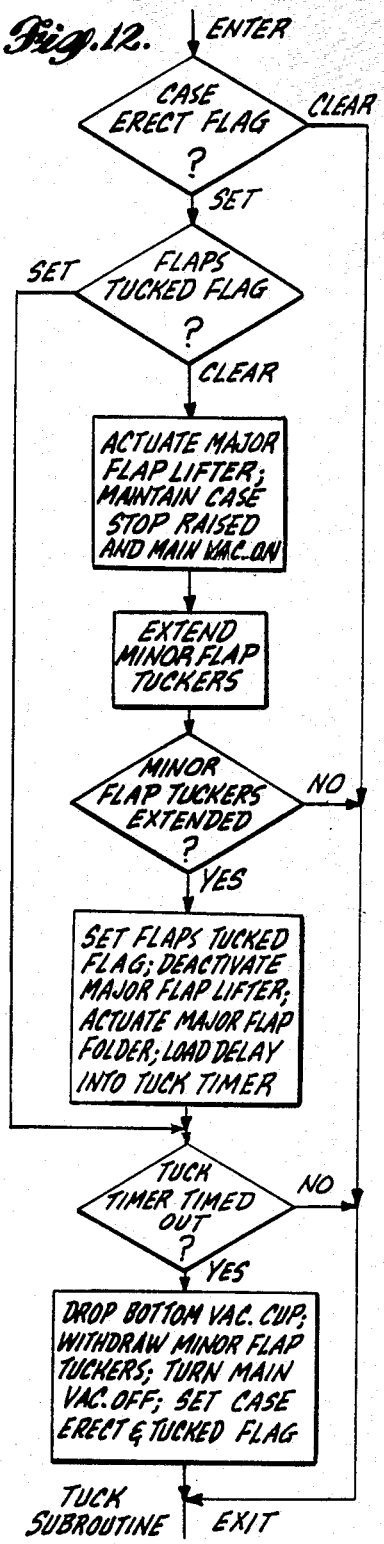
FIG. 12 is a flow diagram of a tuck subroutine suitable for inclusion in the run subroutine illustrated in FIG. 10.
Figure 13A:
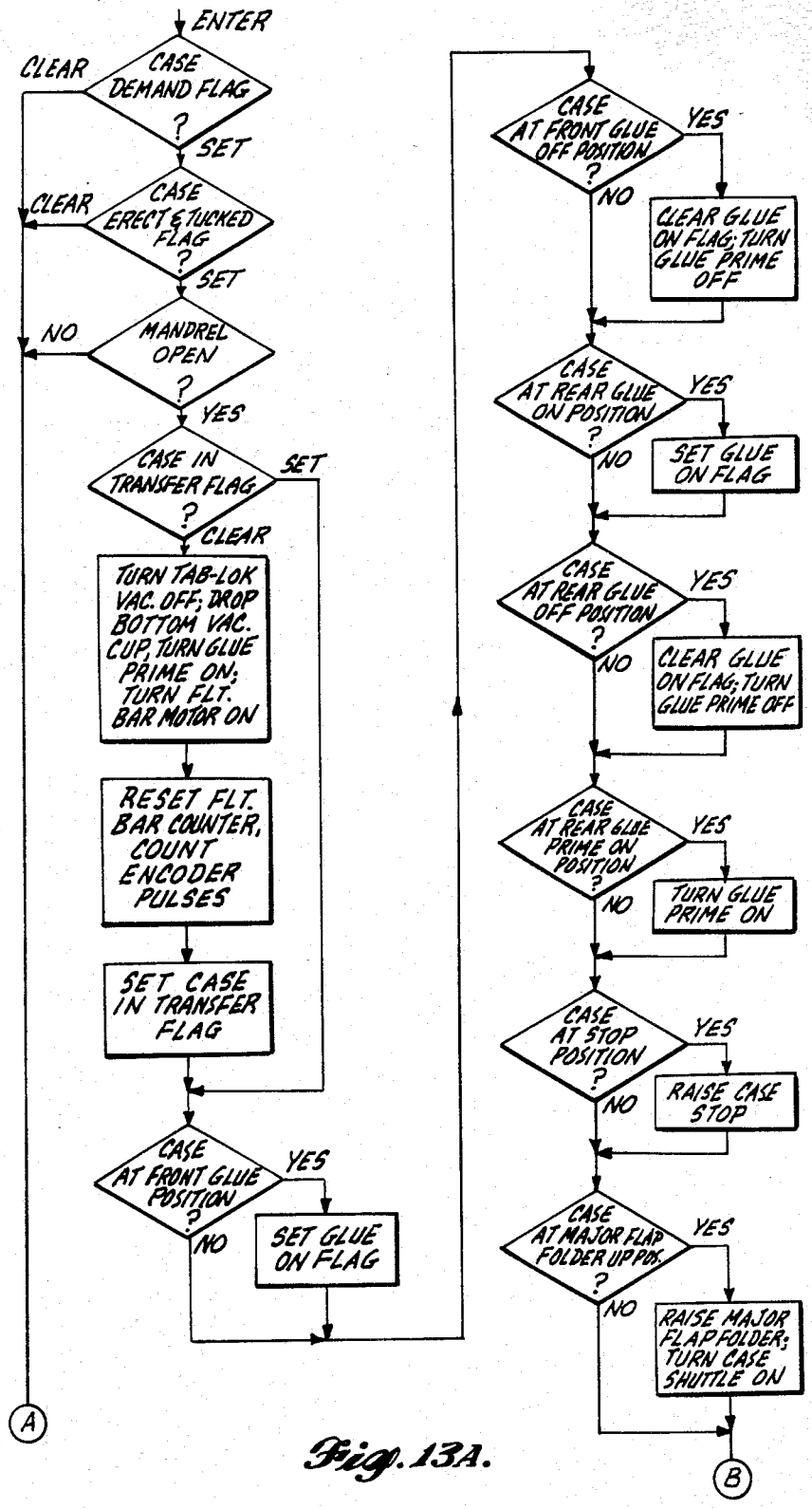
Figure 14:
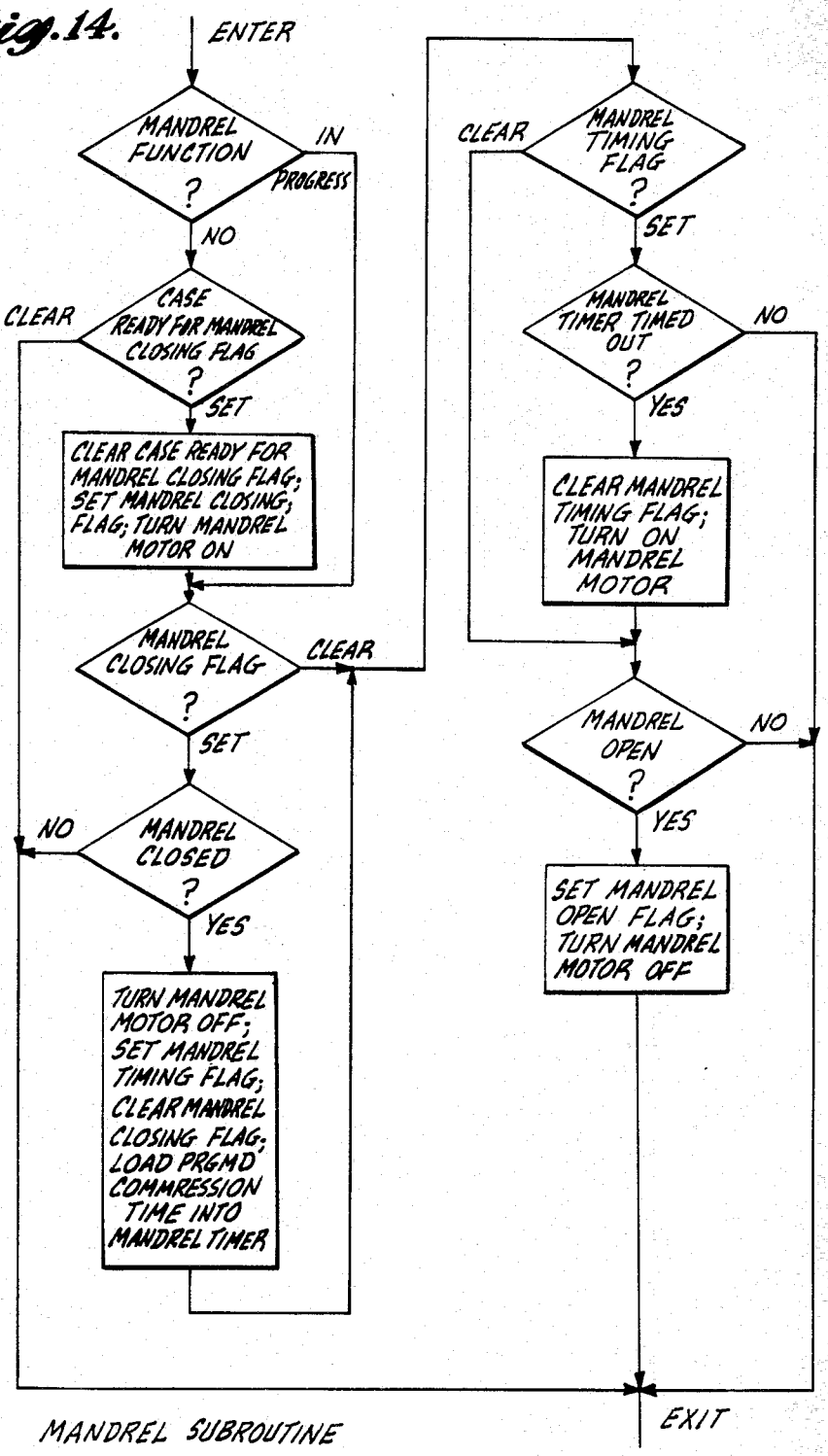
FIG. 14 is a flow diagram of a mandrel subroutine suitable for inclusion in the run subroutine illustrated in FIG. 10; and, FIG. 15 is a flow diagram of a timing subroutine suitable for inclusion in the run subroutine illustrated in FIG. 10.

The first step in the run subroutine loop shown on the right side of FIG. 10 is a pass through the erect subroutine illustrated in FIG. 11. The first step in the erect subroutine is a test to determine if the case in set-up station flag is set. If the case in set-up station flag is clear, the remaining steps of the erect subroutine are bypassed and the run program cycles to the tuck subroutine illustrated in FIG. 12 and described below.

If the case in set up station flag is set, the bottom vacuum cup 30 is raised. Thereafter, the main vacuum switch is tested to determine if the bottom and top vacuum cups 30 and 33 have attached themselves to the bottom and top, respectively, of the flattened case located in the case set-up station. The remaining steps of the erect subroutine are bypassed until such attachment occurs. After bottom and top vacuum cup attached occurs as determined by the state of the main vacuum switch, a test of the Tab-Lok vacuum sensing switch 87 is made to determine whether or not the Tab-Lok vaccum cup 37 has attached itself to the lower Tab-Lok flaps of the case located beneath the hopper, which case will be moved to the case set-up station at the same time the case in the case set-up station is moved to the mandrel station. Until this test is positive the remaining steps of the erect subroutine are again bypassed and the run subroutine cycles to the tuck subroutine illustrated in FIG. 12 and hereinafter described. When the Tab-Lok vacuum test turns positive, the case erect arm is raised (e.g., retracted) and the Tab-Lok vacuum arm 39 is dropped. As a result, as the case in the case set-up station erected and the lower Tab-Lok flaps of the flattened case located beneath the hopper are folded. As noted above, as the lower Tab-Lok flaps are folded by being pulled down as the Tab-Lok vacuum arm drops, the bracket 41 is moved into position.

Next, a test is made to determine if the case erect arm 31 is retracted. This test is accomplished by testing the state of the case erect arm retracted switch 87. As long as this remains negative the remaining steps of the erect subroutine are bypassed during subsequent passes through the erect subroutine. When the case erect art retracted test turns positive a case erect flag is set and a flaps tucked flag is cleared. Thereafter, the run subroutine cycles to the tuck subroutine illustrated in FIG. 12 and next described.

The first step in the tuck subroutine is a test of the case erect flag. If the case erect flag is clear, the remaining steps of the tuck subroutine are bypassed and the sequence of operation shifts to a run-program switch test shown on the right side of FIG. 10 beneath the tuck subroutine block. If the case erect flag is set, a test is made of the flaps tucked flag. If the flag tucked flag is set, the remaining steps to the tuck subroutine are bypassed and the program sequences to the run-program switch test noted above. If the flaps tucked flag is clear, the major flap lifter 35 is actuated. Further, the case stop 29 is maintained in its raised position and the main vacuum is maintained on so that the erected case is held in its stopped and erected position. Thereafter, both minor flap tuckers 41 and 43 are extended. Next, a test is made to determine if both of the minor flap tuckers are fully extended. This test is accomplished by testing the state of the leading and trailing minor flap in sensing switches 89 and 91. As long as this test remains negative, the remaining steps of the tuck subroutine are bypassed and the sequence of operation cycles to the run-program switch test. When the minor flap tuckers extended test turns positive, the flaps tucked flag is set, the major flap lifter 33 is deactivated, the major flap folder 45 is actuated and a delay is loaded into a tuck timer. The tuck timer forms part of a hereinafter described timing subroutine. During subsequent passes through the tack subroutine the tuck timer is tested to determine if it has timed out. As long as this test remains negative the remaining steps of the tuck subroutine are bypassed. After the tuck timer has timed out, the bottom vacuum cup 30 is dropped, the minor flap tuckers are withdrawn, the main vacuum is turned off and a case erect and tuck flag is set. Thereafter, the sequence of operation shifts to the run-program switch test illustrated on the right side of FIG. 10.

If at any time the run-program switch test contained in the loop of the run subroutine determines that the run-program switch has been shifted from the run position to the program position, the run subroutine ends and the sequence of operation shifts to the point where the main program is entered as illustrated in FIG. 4. As long as the run-program switch remains in the run position, as shown on the right side of FIG. 10, after each pass through the tuck subroutine, a test of the case in set-up station flag is made. If the case in set-up station flag is clear, the run subroutine cycles to the transfer subroutine illustrated in FIGS. 13A and B and hereinafter described. If the case in setup station flag is set, a test is made of the case demand switch. As noted above the case demand switch is a manual switch controlled by the assumbly line receiving cases erected and seated by the case set-up and sealing machine of the invention. If no case demand exists, the run subroutine cycles to the transfer subroutine. If a case demand exists, a case demand flag is set and, then, the run subroutine cycles to the transfer subroutine illustrated in FIGS. 13A and B and next described.

The first step in the transfer subroutine is a test of the case demand flag. If the case demand flag is clear the remaining steps of the transfer subroutine are bypassed. If the case demand flag is set, a test of the case erect and tuck flag is made. If the case erect and tucked flag is clear, the remaining steps of the transfer subroutine are bypassed and the run subroutine cycles to the mandrel subroutine illustrated in FIG. 14 and described below. If the case erect and tucked flag is set, a test is made to determine if the mandrel 24 is retracted. This test is accomplished by testing the state of the mandrel open switch 93. If the mandrel is not retracted, the remaining steps of the transfer subroutine are bypassed and the run subroutine cycles to the mandrel subroutine illustrated in FIG. 14 and described below.

If the mandrel is open or retracted, a test is made of a case in transfer flag that is set and cleared in the manner described below. If the case in transfer flag is set, the transfer subroutine cycles to a case at front glue position test illustrated on the left side of FIG. 13A. If the case in transfer flag is clear, Tab-Lok vacuum is turned off, the bottom vacuum cup 30 is dropped, the glue prime is turned on and the flight bar motor is turned on. Thereafter, a flight bar counter is reset to zero and conditioned to count pulses subsequently produced by the flight bar encoder. Next, the case in transfer flag is set. As a result, during the "next" pass through this portion of a transfer subroutine, the just described steps are bypassed. (Unless, of course, the case in transfer flag is cleared before the next pass occurs.)

After the case in transfer flag has been set, the case at front glue position test previously referred to is made. The case at front glue position test, compares the pulse count of the flight bar counter with the front glue position value determined and stored during the glue pattern calculate subroutine (FIG. 9). If the case is at the front glue position, a glue on flag is set. After the glue on flag has been set, or if the case is not at the front glue on position, a test is made to determine if the case is at the front glue off position. Again, this test is accomplished by comparing the pulse count of the flight bar counter (at the time the test is made) with the glue off position value determined and stored during the glue pattern calculate subroutine. If the case is at the front glue off position, the glue on flag is cleared and the glue prime is turned off.

After the glue prime has been turned off and the glue on flag has been cleared, or if the case is not at the front glue off position, a test is made to determine if the case is at the rear glue on position. This test is also made by comparing the pulse count of the flight bar counter with the rear glue on position determined and stored during the glue pattern calculate subroutine. If the case is at the rear glue on position, the glue on flag is again set. After the glue on flag is set, or if the case is not at the rear glue on position, a test is made to determine if the case is at the rear glue off position. Again this test is made by comparing the pulse count of the flight bar counter with the rear glue off position determined and stored during the glue pattern calculate subroutine. If the case is at the rear glue off position, the glue on flag is again cleared and the glue prime is again turned off. After the glue prime has been turned off and the glue on flag cleared for the second time, or if the case is not at the rear glue off position, a test is made to determine if the case is at the rear glue prime on position. This test is also accomplished by comparing the pulse count of the flight bar counter (when the test is made) with the rear glue prime on positive determined and stored during the glue pattern calculate subroutine (FIG. 9). If the case is at the rear glue prime on position, the glue prime is turned on.

After the glue prime has been turned on, or if the case is not at the rear glue prime on position, the transfer subroutine shifts from glue related tests to tests to determine whether or not the case has cleared the case set-up station by an amount adequate to allow the stop 29 to be raised to stop the case being moved from beneath the hopper to the case set-up station. More specifically, after the glue prime has been turned on or if the case at rear glue prime on position test determines that the case is not at the rear glue prime on position, a test is made to determine if the end of the case has cleared the stop position. This test, denoted as the case at stop position test, is accomplished by comparing the pulse count of the flight bar counter with a pulse count value stored in the permanent memory of the programmable case set-up and bottom sealing machine. If the comparison is positive the case stop 29 is raised.

After the case stop has been raised, or if the case at stop position test is negative, a test is made to determine if the case is at the major flap folder up position. This test is also accomplished by comparing the pulse count of the flight bar counter with a pulse count stored in the permanent memory of the programmable case set-up and bottom sealing machine. If the comparison is positive, the major flap folder 45 is raised. At the same time the shuttle 19 is actuated.

After the major flap folder 45 is raised and the shuttle 19 actuated, or if the case is not at the major flap folder up position, a test is made to determine if the case is at the erect arm down position. That is, if the case being transferred from the case set-up station 21 to the mandrel station 23 has cleared the case set-up station by an adequate amount, as determined by a comparison of the pulse count of the flight bar counter with a pulse count stored in the permanent memory, the case erect arm 31 is dropped and the Tab-Lok vacuum arm 39 is raised.

After the case erect arm 31 has been dropped and the Tab-Lok vacuum arm 39 raised or if the case being transferred has not passed the erect arm down position, a test is made to determine if the glue on flag has been set. If the glue on flag is clear, the glue is turned off and the transfer subroutine shifts to a flight bar counter equal (=) X inches test described below. If the glue on flag is set, a test is made to determine if the glue pattern is to follow a stitch format or a non-stitch format. If the glue pattern is not to follow a stitch format (i.e., if a continuous glue pattern was programmed during the glue-stitch program subroutine), a test is made to determine if the programmable controller was programmed during the glue-stitch program subroutine to glue the bottoms of cases passing the glue head. If glue has not been programmed on, the transfer subroutine cycles to the turn glue off step and, then, to the flight bar counter equal X inches test described below. If glue has been programmed on, the glue head is actuated and the transfer subroutine cycles to the flight bar counter equal X inches test.

If the glue pattern is programmed to follow a stitch format (which, inherently, means that glue is to be applied), a predetermined bit of the flight bar counter is tested to determine if it is high or low. If the bit is high, the glue head is actuated and glue is emitted. Thereafter, the transfer subroutine cycles to the flight bar counter=X inches test. Contrariwise, if the tested flight bar counter bit is low, the glue head is deactivated and, then, the flight bar counter=X inches test occurs. As will be readily appreciated from this description, the tested flight bar counter bit controls the stitch length of the stitch format.

The flight bar counter=X inches test included to avoid the detection of false sync pulses. False sync pulses can occur if the sync switch bounces, for example. The flight bar counter=X test requires that the flight bar move X inches before a new sync pulse is recognized after a prior sync pulse has caused the hereinafter described steps (illustrated on the right side of FIG. 13B) to occur; X may equal four (4), for example. When the flight bar counter=X inches test result is positive, an OK to look for sync flag is set. At the same time, the Tab-Lok flap lifter 44 is actuated to lift the upper Tab-Lok flaps of a flattened case being moved into the case erect station 21. After the flight bar counter=X inches test occurs or after the OK to look for sync flag has been set and the Tab-Lok flap lifter has been actuated (if the test is positive), a test is made to determine if the OK to look for sync flag has been set. If the OK to look for sync flag is clear, meaning that the flight bar has not yet reached the flight bar counter=X inches position, the transfer subroutine ends and the run subroutine cycles to the mandrel subroutine illustrated in FIG. 14 and described below.

If the OK to look for sync flag is set, a test is made to determine if a flight bar sync pulse is present. If no flight bar sync pulse is present, the transfer subroutine ends and the run subroutine cycles to the mandrel subroutine. If a flight bar sync pulse is present, the flight bar motor is turned off and the main vacuum is turned on. Further, the detection of encoder pulses by the flight bar counter is disabled, to avoid the incrementing of the flight bar counter by pulses that occur during coast down of the chain driven flight bar mechanism. Also, Tab-Lok vacuum is turned on and the shuttle actuator 137 is turned off. Next, the case counter is incremented. Then, a test of the case counter is made to determine if the case counter value is greater than the numerical value 9999. If the case counter value is greater than the numerical value 9999, the case counter is cleared. After the case counter has been cleared, or if the case counter value is less than 9999, the case counter value is displayed. As will be readily appreciated, the value 9999 is chosen because this is the maximum numerical value that can be displayed on the four character alphanumeric display 109 of the control/display unit 75. After the case count value has been displayed, the case in transfer flag is cleared, the case in mandrel station flag is set and the case in set-up station flag is set. Thereafter, the transfer subroutine ends and the run subroutine cycles to the mandrel subroutine illustrated in FIG. 14, which is next described.

The first step in the mandrel subroutine is a test to determine if the mandrel is operating. Basically this is a test of various flags and switches to determine if the mandrel is closing, compressing the bottom flags of a case or opening. If any one of these mandrel functions are occurring, the mandrel subroutine cycles to a mandrel closing flag test described below. If none of these mandrel functions are occurring, a case ready for mandrel closing flag is tested. If the case ready for mandrel closing flag is clear, the remaining steps of the mandrel subroutine are bypassed and the run program cycles to the timing subroutine illustrated in FIG. 15 and described below.

If the case ready for mandrel closing flag is set, the case ready for mandrel closing flag is cleared, a mandrel closing flag is set and the mandrel motor is turned on causing a crank to rotate and move the mandrel into a case. Thereafter, the mandrel closing flag test takes place. If the mandrel closing flag is clear, the mandrel subroutine cycles to a mandrel timing test described below.

If the mandrel closing flag is set, a test is made to determine if the mandrel is closed by testing the state of the mandrel closed switch 95. If the mandrel closed test is negative, the remaining steps of the mandrel subroutine are bypassed and the run program cycles to the timing subroutine illustrated in FIG. 15. If the mandrel closed test is positive, the mandrel motor is turned off and a mandrel timing flag is set. Further, the mandrel closing flat is cleared and the compression time programmed by the operator in the manner previously described is loaded into a mandrel timer, which is used by the timing subroutine described below. Thereafter, the mandrel timing flag test is performed.

If the mandrel timing flag is clear, the mandrel subroutine cycles to a mandrel open test described below. If the mandrel timing flag is set, a test is made to determine if the mandrel timer has timed out. If the mandrel timer has not timed out, the remaining steps of the mandrel subroutine are bypassed and the run subroutine cycles to the timing subroutine illustrated in FIG. 15. If the mandrel timer has timed out, the mandrel timing flag is cleared and the mandrel motor is turned on. When the mandrel motor is turned on the crank rotated by the mandrel motor withdraws the mandrel from the interior of the case being sealed. Thereafter, the mandrel open test is performed.

The mandrel open test is performed by testing the state of the mandrel open switch. If the mandrel is not open, the mandrel subroutine ends and the run subroutine cycles to the timing subroutine illustrated in FIG. 15 and described below. If the mandrel is open, a mandrel open flag is set and the mandrel motor is turned off. Thereafter, the mandrel subroutine ends and the run subroutine cycles to the timing subroutine illustrated in FIG. 15 and next described.

Figure 15:
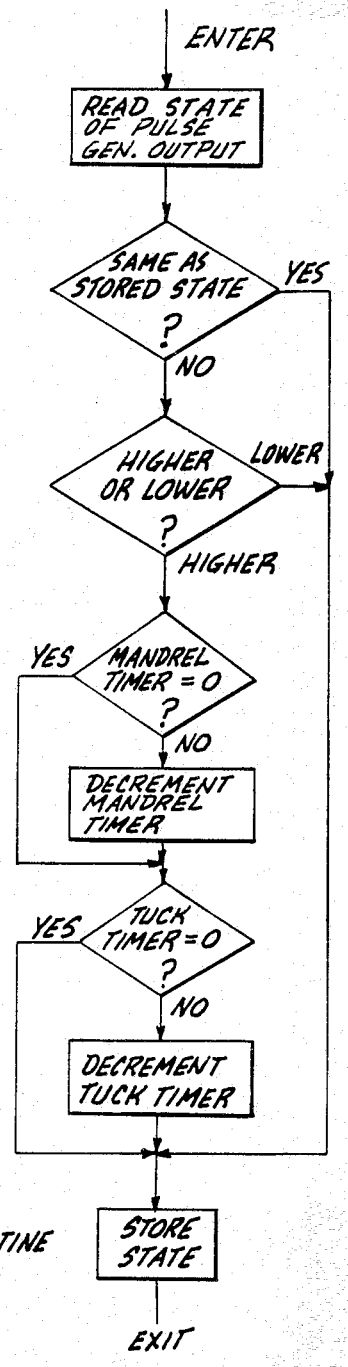

As illustrated in FIG. 15, the first step of the timing subroutine is to read the output state of a pulse generator. Next, the output state is compared with a stored state. The stored state is the output state of the pulse generator read and stored during the immediately preceeding pass through the timing subroutine. If the read state and the stored state are the same, meaning that the output state has not changed since the last pass through the timing subroutine, the timing subroutine cycles to a store state step. When this path is followed, the stored state at the end of a pass through the timing subroutine is the same as the stored state at the beginning of the pass through the timing subrouting. Thereafter, as illustrated in FIG. 10, the run subroutine cycles to the point where the erect subroutine (illustrated in FIG. 11 and heretofore described) is entered.

If the read output state is different than the stored state, a test is made to determine if the read state is higher or lower. If lower, the timing subroutine again cycles to the store state step previously described and, then, to the erect subroutine. If the read state is higher than the stored state, both a mandrel timer and a tuck timer are tested and decremented, until the counter values equal zero. In this regard, as will be understood from the previous description of the tuck and mandrel subroutines, when an appropriate path through each of these subroutines is followed a timing value is loaded into a timer, which may form part of the random access memory (RAM). During passes through the timing subroutine, these timers are decremented in the manner just described. When tests of the timers are later performed during subsequent passes through the tuck and mandrel subroutines, it is the decremented timer values that are tested to determine if the timers have timed out.

After the tuck and mandrel timers have been decremented, the previously read output state is loaded in memory and forms a new stored state. Thereafter the timing subroutine ends and the run subroutine cycles to the erect subroutine illustrated in FIG. 11 and heretofore described.

In summary, when the programmable case set-up and bottom sealing machine of the invention is in the run mode of operation, initially, the machine is set up by operating various of the subsystems in a manner similar to the way the subsystems are operated during later passes through a closed loop. The initial steps are required because cases may be located in the machine stations and because the position of the chain driven flight bar mechanism is unknown. As the initial run steps take place, any cases in the machine are processed and a preloaded case is moved from beneath the hopper 17 to case erect station 21. After the initial run steps are performed, the run subroutine enters a closed loop wherein the boxes are continuously erected and sealed, as long as the run-program switch remains in the run position and a demand switch is in a state demanding that cases to be continuously erected and sealed. If the demand switch shifts states, machine operation is temporarily halted until the demand switch is returned to the demand state. Because of this and other features programmable case set-up and bottom sealing machines formed in accordance with the invention are ideally suited for use in assembly line environments.

As will be readily appreciated from the foregoing description of a preferred embodiment, the invention provides a programmable case set-up and bottom sealing machine whose mode of operation can be rapidly changed. The overall programming of the machine is readily and quickly accomplished by an operator inserting certain minimal information via a keyboard. Because the complexities of prior art mechanical control systems is avoided, the need for skilled employees to manually adjust complicated mechanical sytems is avoided. Moreover, machine down time required for readjustment for different box sizes, glue configurations, etc., is greatly reduced. Finally, the disadvantages flowing from wear and other factors associated with mechanical control systems is avoided. Moreover, the machine is versatile. It can be used to erect either Tab-Lok or nonTab-Lok cases. Further, the cases can be erected and sealed, or simply erected. And, the glue pattern, (if the erected cases are to be sealed) can be continuous or stitched, as desired. Finally, the glue pattern is readily easily adjusted based on the length of the cases to be erected. More specifically, the length of both the stitch and glue pattern is based on the length of cases to be erected and sealed, which information is inserted by the operator. As a result, excessive glue consumption and spattering is avoided.

While a preferred embodiment of the invention has been illustrated and described, it will be appreciated that various changes can be made therein without departing from the spirit and scope of the invention. Consequently, the invention can be practiced otherwise than as specifically described herein.

The embodiments of the invention in which an exclusive property or privilege is claimed are defined as follows:

1. A programmable case set-up and bottom sealing machine comprising:

(A) conveyor means for receiving flattened cases from a hopper and sequentially moving said cases first to a case set-up station and, then, to a mandrel station;

(B) erecting means located at said case set-up station for erecting flattened cases moved to said case set-up station by said conveyor means;

(C) flap folding means located at said case set-up station for selectively folding the bottom minor and major flaps of cases erected by said erecting means;

(D) compression means located at said mandrel station for pressing together the folded bottom minor and major flaps of an erected case moved from said case set-up station to said mandrel station by said conveyor means;

(E) a control/display unit for receiving programming information and instructions entered by an operator and displaying operator usable alphanumeric information;

(F) a plurality of sensing devices coupled to said conveyor means, said erecting means, said flap folding means and said compression means for sensing the operation of said conveyor means, said erecting means, said flap folding means and said compression means;

(G) a plurality of controlled devices coupled to said conveyor means, said erecting means, said flap folding means and said compression means for controlling the operation of said conveyor means, said erecting means, said flap folding means and said compression means; and, (H) a central processing unit coupled to said control/-display unit, said plurality of sensing devices and said plurality of controlled devices for:

(1) receiving and storing said programming information and instructions entered by an operator;

(2) receiving information reagrding the operation of said conveyor means, said erecting means, said flap folding means and said compression means sensed by said sensing means; and, (3) controlling said conveyor means, said erecting means, said flap folding means and said compression means via said plurality of controlled devices such that:

(a) flattened case are moved by said conveyor means to said case set-up station;

(b) flattened cases moved to said case set-up station by said conveyor means are erected at said case set-up station by said erecting means;

(c) the bottom minor and major flaps of erected, cases at said case set-up station are selectively folded by said flap folding means;

(d) erected and bottom flap folded cases are moved by said conveyor means to said mandrel station; and, (e) the bottom minor and major flaps of cases at said mandrel station are compressed by said compression means.

2. A programmable case set-up and bottom sealing machine as claimed in claim 1 including glue applying means located along the path of travel of a case between said case set-up station and said mandrel station for selectively applying glue to the bottom flaps of a case moved by said conveyor means from said set-up station to said mandrel station.

3. A programmable case set-up and bottom sealing machine as claimed in claim 2 wherein said programming information and instructions entered by an operator via said control/display unit includes a glue on/off instruction and wherein said central processing unit is also coupled to said glue applying means and controls the emission of glue by said glue applying means as a case is moved by said conveyor means from said case set-up station to said mandrel station in accordance with said glue on/off instruction.

4. A programmable case set-up and bottom sealing machine as claimed in claim 3 wherein said programming information and instructions entered by an operator also includes information about the length of cases to be set-up by said programmable sealing machine and wherein said central processing unit determines and controls the overall length of the glue pattern to be emitted by said glue applying means when a case is moved by said conveyor means from said case set-up station to said mandrel station based on said case length information.

5. A programmable case set-up and bottom sealing machine as claimed in claim 4 wherein said programming information and instructions entered by an operator also includes a stitch on/off instruction and wherein said central processing unit controls the format of the pattern of the glue emitted by said glue applying means as a case is moved by said conveyor means from said case set-up station to said mandrel station in accordance with said stitch on/off instruction.

6. A programmable case set-up and bottom sealing machine as claimed in claim 5 wherein said programming information and instructions entered by an operator also includes a glue pattern length instruction and wherein said central processing unit controls the length of individual patterns of glue emitted by said glue applying means as a case is moved by said conveyor means from said case set-up station to said mandrel station in accordance with said glue pattern length instruction.

7. The programmable case set-up and bottom sealing machine as claimed in claim 6 wherein said programming information and instructions entered by our operator also includes a compression time instruction and wherein said central processing unit controls said compression means in accordance with said compression time instruction.

8. A programmable case set-up and bottom sealing machine as claimed in claim 7 wherein said central processing unit includes programming subroutines and a run subroutine.

9. A programmable case set-up and bottom sealing machine as claimed in claim 8 wherein said programming subroutines include a glue pattern calculate subroutine that determines the starting and stopping points of front and rear glue patterns based on said case length information and pattern length instructions entered by an operator.

10. A programmable case set-up and bottom sealing machine as claimed in claim 9 wherein said run subroutine includes a series of initialization steps during which partially erected and/or sealed cases located at said case set-up and mandrel stations are completed and during which the position of said conveyor means is determined.

11. A programmable case set-up and bottom sealing machine as claimed in claim 10 wherein said run subroutine includes a loop that is entered, after said series of initialization steps are completed, during which cases are continuously moved to said case set-up station and from said case set-up station to said mandrel station, said cases being set-up and bottom sealed by said erecting means, said flap folding means and said compression means as they are moved.

12. A programmable case set-up and bottom sealing machine as claimed in claim 11 wherein said plurality of sensing devices includes a sync switch positioned so as to produce a sync pulse when said conveyor means is in a predetermined position.

13. A programmable case set-up and bottom sealing machine as claimed in claim 12 including a chain position encoder connected to said conveyor means for producing pulses as said conveyor means moves and wherein said central processing unit includes a counter that counts said chain pulses and uses the resultant pulse count information to control the application of glue by said glue applying means as cases are moved from said case set-up station to said mandrel station.

14. A programmable case set-up and bottom sealing machine as claimed in claim 2 wherein said programming information and instructions entered by an operator also include information about the length of cases to be set-up by said programmable case set-up and bottom sealing machine and wherein said central processing unit determines and controls the overall length of the glue pattern to be emitted by said glue applying means when a case is moved by said conveyor means from said case set-up station to said mandrel station based on said case length information.

15. A programmable case set-up and bottom sealing machine as claimed in claim 14 wherein said programming information and instructions entered by an operator also include a stitch on/off instruction and wherein said central processing unit controls the format of the pattern of the glue emitted by said glue applying means as a case is moved by said conveyor means from said case set-up station to said mandrel station in accordance with said stitch on/off instruction.

16. A programmable case set-up and bottom sealing machine as claimed in claim 15 wherein said programming information and instructions entered by an operator also includes a glue pattern length instruction and wherein said central processing unit controls the length of individual patterns of glue emitted by said glue applying means as a case is moved by said conveyor means from said case set-up station to said mandrel station in accordance with said glue pattern length instruction.

17. A programmable case set-up and bottom sealing machine as claimed in claim 16 wherein said programming information and instructions entered by an operator also include a compression time instruction and wherein said central processing unit controls said compression means in accordance with said compression time instruction.

18. A programmable case set-up and bottom sealing machine as claimed in claim 17 wherein said central processing unit includes programming subroutines and a run subroutine.

19. A programmable case set-up and bottom sealing machine as claimed in claim 18 wherein said programming subroutines include a glue pattern length subroutine that determines the starting and stopping points of front and rear glue patterns based on said case length information and pattern length instructions entered by an operator.

20. A programmable case set-up and bottom sealing machine as claimed in claim 19 wherein said run subroutine includes a series of initialization steps during which partially erected and/or sealed cases located at said case set-up and mandrel stations are completed and during which the position of said conveyor means is determined.

21. A programmable case set-up and bottom sealing machine as claimed in claim 20 wherein said run subroutine includes a loop that is entered, after said series of initialization steps are completed, during which cases are continuously moved to said case set-up station and from said case set-up station to said mandrel stations, said cases being set-up and bottom sealed by said erecting means, said flap folding means and said compression means as they are moved.

22. A programmable case set-up and bottom sealing machine as claimed in claim 21 wherein said plurality of sensing devices includes a sync switch positioned so as to produce a sync pulse when said conveyor means is in a predetermined position.

23. A programmable case set-up and bottom sealing machine as claimed in claim 22 including a chain position encoder connected to said conveyor means for producing pulses as said conveyor means moves and wherein said central processing unit includes a counter that counts said chain pulses and uses the resultant pulse count information to control the application of glue by said glue applying means as cases are moved from said case set-up station to said mandrel station.

24. A programmable case set-up and bottom sealing machine as claimed in claim 2 wherein said programming information and instructions entered by an operator include a stitch on/off instruction and wherein said central processing unit controls the format of the pattern of the glue emitted by said glue applying means as a case is moved by said conveyor means from said case set-up station to said mandrel station in accordance with said stitch on/off instruction.

25. A programmable case set-up and bottom sealing machine as claimed in claim 24 wherein said programming information and instructions entered by an operator also includes a glue pattern length instruction and wherein said central processing unit controls the length of patterns of glue emitted by said glue applying means as a case is moved by said conveyor means from said case set-up station to said mandrel station in accordance with said glue pattern length instruction.

26. A programmable case set-up and bottom sealing machine as claimed in claim 25 wherein said programmable information and instructions entered by an operator also include a compression time instruction and wherein said central processing unit controls said compression means in accordance with said compression time instruction.

27. A programmable case set-up and bottom sealing machine as claimed in claim 26 wherein said central processing unit includes a run subroutine that includes a series of initialization steps during which partially erected and/or sealed cases located at said case set-up and mandrel stations are completed and during which the position of said conveyor means is determined.

28. A programmable case set-up and bottom sealing machine as claimed in claim 27 wherein said run subroutine includes a loop that is entered, after said series of initialization steps are completed, during which cases are continuously moved to said case set-up station and from said case set-up station to said mandrel stations, said cases being set-up and bottom sealed by said erecting means, said flap folding means and said compression means as they are moved.

29. A programmable case set-up and bottom sealing machine as claimed in claim 28 wherein said plurality of sensing devices includes a sync switch positioned so as to produce a sync pulse when said conveyor means is in a predetermined position.

30. A programmable case set-up and bottom sealing machine as claimed in claim 29 including a chain position encoder connected to said conveyor means for producing pulses as said conveyor means moves and wherein said central processing unit includes a counter that counts said chain pulses and uses the resultant pulse count information to control the application of glue by said glue applying means as cases are moved from said case set-up station to said mandrel station.

31. A programmable case set-up and bottom sealing machine as claimed in claim 2 wherein said programming information and instructions entered by an operator also include a glue pattern length instruction and wherein said central processing unit controls the length of individual patterns of glue emitted by said glue applying means as a case is moved by said conveyor means from said case set-up station to said mandrel station in accordance with said glue pattern length instruction.

32. A programmable case set-up and bottom sealing machine as claimed in claim 31 wherein said programming information and instructions entered by our operator also include a compression time instruction and wherein said central processing unit controls said compression means in accordance with said compression time instruction.

33. A programmable case set-up and bottom sealing machine as claimed in claim 36 wherein said central processing unit includes run subroutine that includes a series of initialization steps during which partially erected and/or sealed cases located at said case set-up and mandrel stations are completed and during which the position of said conveyor means is determined.

34. A programmable case set-up and bottom sealing machine as claimed in claim 33 wherein said run subroutine includes a loop that is entered, after said series of initialization steps are completed, during which cases are continuously moved to said case set-up station and from said case set-up station to said mandrel stations, said cases being set-up and bottom sealed by said erecting means, said flap folding means and said compression means as they are moved.

35. A programmable case set-up and bottom sealing machine as claimed in claim 34 wherein said plurality of sensing devices includes a sync switch positioned so as to produce a sync pulse when said conveyor means is in a predetermined position.

36. A programmable case set-up and bottom sealing machine as claimed in claim 35 including a chain position encoder connected to said conveyor means for producing pulses as said conveyor means moves and wherein said central processing unit includes a counter that counts said chain pulses and uses the resultant pulse count information to control the application of glue by said glue applying means as cases are moved from said case set-up station to said mandrel station.

37. A programmable case set-up and bottom sealing machine as claimed in claim 1 wherein said programming information and instructions entered by our operator also include a compression time instruction and wherein said central processing unit controls said compression means in accordance with said compression time instruction.

38. A programmable case set-up and bottom sealing machine as claimed in claim 1 wherein said central processing unit includes run subroutine that includes a series of initialization steps during which partially erected and/or sealed cases located at said case set-up and mandrel stations are completed and during which the position of said conveyor means is determined.

39. A programmable case set-up and bottom sealing machine as claimed in claim 38 wherein said run subroutine includes a loop that is entered, after said series of initialization steps are completed, during which cases are continuously moved to said case set-up station and from said case set-up station to said mandrel stations, said cases being set-up as they are moved.

* * * * *

UNITED STATES PATENT AND TRADEMARK OFFICE

CERTIFICATE OF CORRECTION

PATENT NO. : 4,515,579

DATED : May 7, 1985

INVENTOR(S) : Joel M. Beckett

It is certified that error appears in the above-identified patent and that said Letters Patent is hereby corrected as shown below:

Column 28, line 16, "36" should be --32--.

Signed and Sealed this

*Twelfth* Day of *November 1985*

[SEAL]

*Attest:*

DONALD J. QUIGG

*Attesting Officer*

*Commissioner of Patents and Trademarks*